US009448029B1

(12) United States Patent
Jacq

(10) Patent No.: US 9,448,029 B1
(45) **Date of Patent: *Sep. 20, 2016**

(54) AUTONOMOUS UNMANNED TOWER MILITARY MOBILE INTERMODAL CONTAINER AND METHOD OF USING THE SAME

(71) Applicant: Emmanuel Daniel Martin Jacq, Washington, DC (US)

(72) Inventor: Emmanuel Daniel Martin Jacq, Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/544,646

(22) Filed: Jan. 29, 2015

Related U.S. Application Data

(62) Division of application No. 13/664,835, filed on Oct. 31, 2012, now Pat. No. 8,978,534.

(51) Int. Cl.
*F41H 13/00* (2006.01)
*F41A 23/20* (2006.01)
*F41G 3/02* (2006.01)

(52) U.S. Cl.
CPC *F41A 23/20* (2013.01); *F41G 3/02* (2013.01)

(58) Field of Classification Search
CPC ..... F41A 23/20; F41G 3/02; F41G 3/165; F41G 5/06
USPC ..... 89/1.11, 1.8, 1.801, 1.802, 1.809, 1.81, 89/1.815
See application file for complete search history.

(56) References Cited

U.S. PATENT DOCUMENTS 8,978,534 B2 * 3/2015 Jacq ..... F41A 23/20 89/1.11
2014/0116234 A1 * 5/2014 Jacq ..... F41A 23/20 89/1.11

* cited by examiner

*Primary Examiner* — Bret Hayes
(74) *Attorney, Agent, or Firm* — Law Office of Jerry Joseph, PLC; Jerry Joseph

(57) ABSTRACT

A method for operating a weapon system including the steps of transporting said weapon system to a desired location, wherein said weapon system comprises an intermodal shipping container, providing power to said weapon system, activating a computer processing unit of said weapon system by a remote operator, assembling said weapon system by means of said computer processing unit, raising an unmanned weapons unit by means of a lifting system, wherein a top flap of said intermodal shipping container is opened and wherein said lifting system is capable of raising and lowering said unmanned weapons unit, and transmitting images from a camera system, wherein said camera system coordinates with said unmanned weapons unit.

8 Claims, 26 Drawing Sheets

3B

3A

AUTONOMOUS UNMANNED TOWER MILITARY MOBILE INTERMODAL CONTAINER AND METHOD OF USING THE SAME

CROSS-REFERENCE TO RELATED APPLICATIONS

This application is a divisional of prior application Ser. No. 13/664,835, filed on Oct. 31, 2012, in the U.S. Patent and Trademark Office, now pending, which claims the benefit of U.S. Provisional Patent Application No. 61/692,598, filed on Aug. 23, 2012, the disclosure of which is incorporated herein in its entirety by reference.

BACKGROUND

1. Field of the Invention

The present invention relates to an unmanned weapon system and a method for using the same. More particularly, the present general inventive concept relates to an autonomous unmanned tower mobile intermodal container weapon (AUTMMIC) system, wherein the weapon is lowered for concealment and raised when it is to be used. In an exemplary embodiment, the AUTMMIC system is designed to fit within a conventional intermodal shipping container and is configured to receive modular components.

2. Description of the Related Art

The current methods of protecting a location or target require live soldiers to guard sand bag fortresses which may be vulnerable to guerilla attacks. However, this method exposes the soldiers to physical, biological, and/or nuclear risks.

In addition, manned protection points require a large amount of support resources such as lodging, food, and hygiene equipment and supplies. Also, these points require massive amounts of man power, machine, and materials to fortify and maintain the position.

Several systems are currently being developed to allow for the protection of a desired location or target, without the need to risk human life.

A related art systems may include a weapon system that is housed within a frame. For example, the patent granted to Helms et al., U.S. Pat. No. 7,013,790 discloses a stealth weapon module that includes a weapon support cage and a weapon, wherein the weapon module is able to be stowed beneath a retractable hard roof of the support cage. However, this module requires a direct power source and will be useless if the power is cut or the batteries expire, since it does not utilize any renewable energy sources such as wind or solar.

While these and other prior art devices may be suitable for their intended applications, none of them solve the various problems addressed by the present invention.

BRIEF SUMMARY OF THE INVENTION

The present general inventive concept provides an unmanned weapon system and a method for using the same.

The present general inventive concept also provides an unmanned mobile intermodal container weapon (AUTMMIC) system, wherein the weapon is lowered for concealment and raised when it is to be used.

The present general inventive concept also provides an unmanned mobile intermodal container weapon (AUTMMIC) system capable of manually or remotely recharging, refueling, and/or communicating to a variety of manned and unmanned vehicles via recharging, refueling, and data transfer stations, respectively.

Additional aspects and utilities of the present general inventive concept will be set forth in part in the description which follows and, in part, will be obvious from the description, or may be learned by practice of the general inventive concept.

The foregoing and/or other aspects of the present general inventive concept may be achieved by providing a weapon system which includes an intermodal shipping container, an unmanned weapons unit, configured to fit substantially within said intermodal shipping container, an energy source capable of providing power to said weapon system, a computing processing unit, wherein computing processing unit is capable of controlling said weapon system, a lifting system, wherein said lifting system is capable of raising said unmanned weapons unit; and a camera system, wherein camera system is capable of capturing images and communicating said images to said computing processing unit.

The foregoing and/or other aspects of the present general inventive concept may also be achieved by providing a weapon system which includes a plurality of intermodal shipping containers, wherein said plurality of intermodal shipping containers are capable of connecting and operating in conjunction with one another, a plurality of unmanned weapons units, configured to fit substantially within said plurality of said plurality of intermodal shipping containers, a plurality of said energy sources capable of providing power to said plurality of weapon systems, a plurality of computing processing units, wherein plurality of computing processing units are capable of controlling said plurality of weapon systems, a plurality of lifting systems, wherein said plurality of lifting systems are capable of raising said plurality of unmanned weapons units and a plurality of camera systems, wherein said plurality of camera systems are capable of capturing images and communicating said images to said plurality of computing processing units.

The foregoing and/or other aspects of the present general inventive concept may also be achieved by providing a method for operating a weapon system including the steps of transporting said weapon system to a desired location, wherein said weapon system comprises an intermodal shipping container, providing power to said weapon system, activating a computer processing unit of said weapon system by a remote operator, assembling said weapon system by means of said computer processing unit, raising an unmanned weapons unit by means of a lifting system, wherein a top flap of said intermodal shipping container is opened and wherein said lifting system is capable of raising and lowering said unmanned weapons unit and transmitting images from a camera system, wherein said camera system coordinates with said unmanned weapons unit.

BRIEF DESCRIPTION OF THE DRAWINGS

The general inventive concept is further described in the detailed description that follows, by reference to the noted drawings by way of non-limiting illustrative exemplary embodiments of the general inventive concept, in which like reference numerals represent similar parts throughout the drawings. As should be understood, however, the general inventive concept is not limited to the precise arrangements and instrumentalities illustrated.

An exemplary embodiment of the present general inventive concept, which in no way limits the claims will now be more particularly described by way of example with reference to the accompanying drawings, wherein:

DETAILED DESCRIPTION OF THE PREFERRED EMBODIMENTS

The present invention relates to an unmanned weapon system and a method for using the same. More particularly, the present general inventive concept relates to an unmanned mobile intermodal container weapon (AUTMMIC) system 100, wherein a weapon system may be lowered for concealment and raised when it is to be used. In an exemplary embodiment, the AUTMMIC system 100 is adaptable to receive modular components, such as power supply, ammunitions, control systems, and missiles. However, the present general inventive concept is not limited thereto.

Figure 1C:
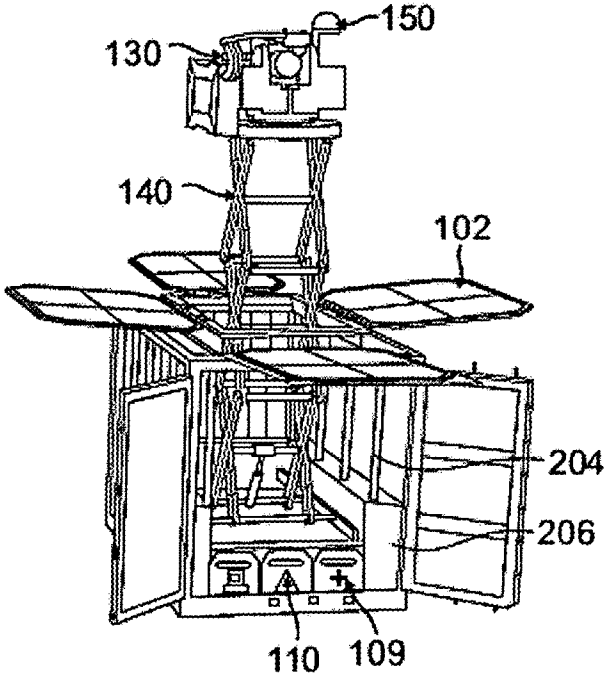
FIG. 1C is a front perspective view of the unmanned system in FIG. 1A in an opened and deployed state.
Figure 1B:
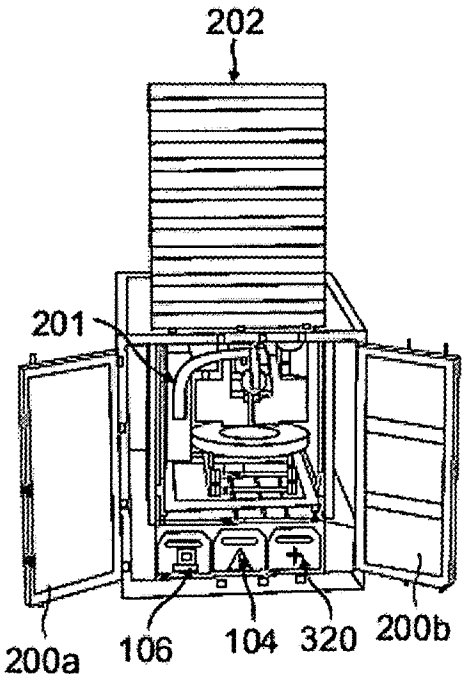
FIG. 1B is a front perspective view of the unmanned system in FIG. 1A in an opened and secured state.
Figure 1A:
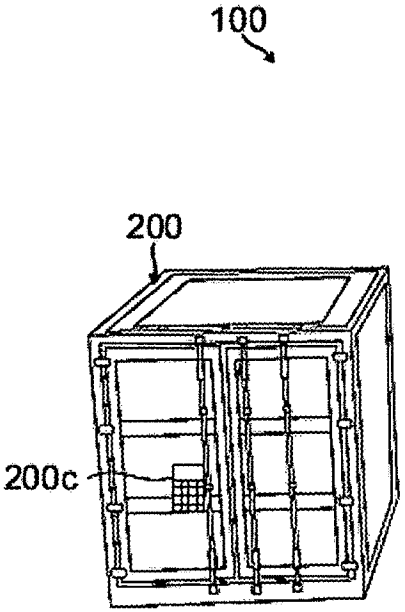
FIG. 1A is a front perspective view of the unmanned system according to an exemplary embodiment of the present general inventive concept in a closed and secured state.
Figure 1D:
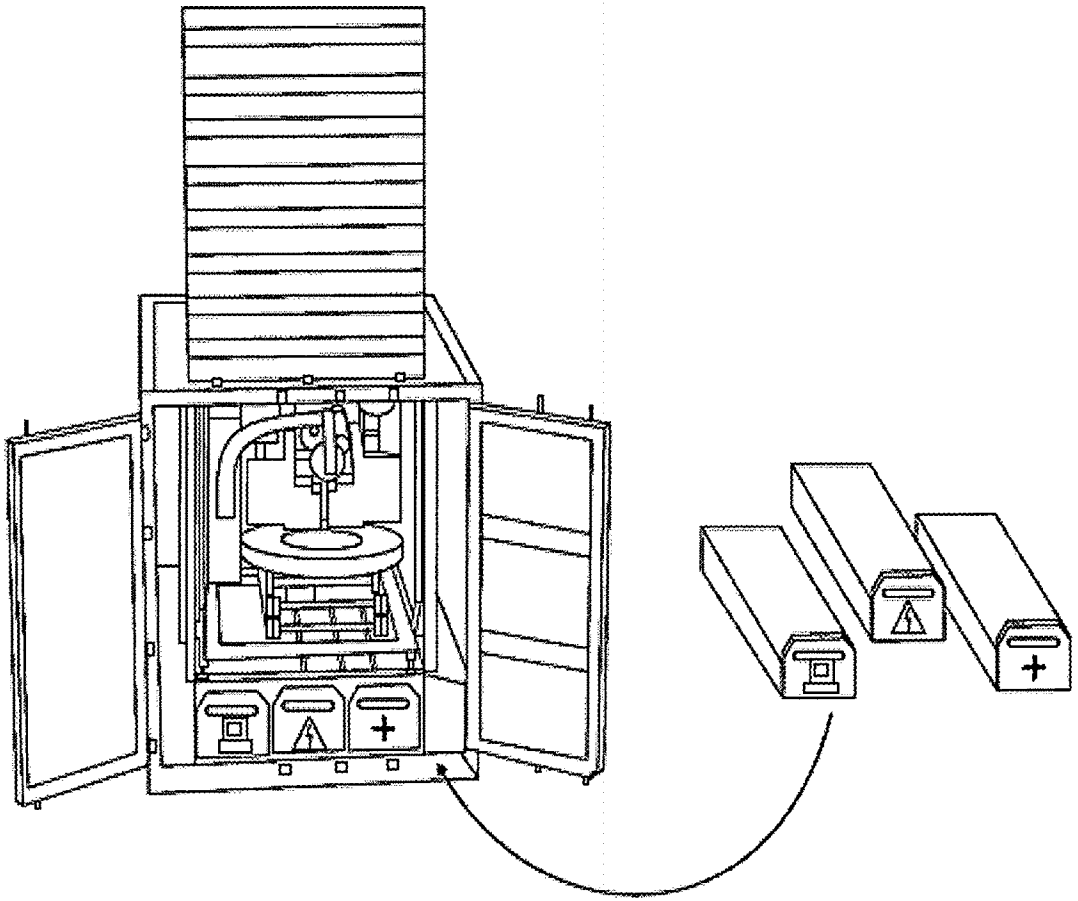
FIG. 1D is a front perspective view of the unmanned system in FIG. 1A in an opened and deployed state illustrating the removable modular components.

FIG. 1A is a front view of the unmanned system 100 according to an exemplary embodiment of the present general inventive concept in a closed and secured state, FIG. 1B is a front view of the unmanned system 100 in FIG. 1A in an opened and secured state, and FIG. 1C is a front view of the unmanned system 100 in FIG. 1A in an opened and deployed state. FIG. 1D is a front perspective view of the unmanned system in FIG. 1A in an opened and deployed state illustrating the removable modular components.

Figures 2A, 2B, 2C:
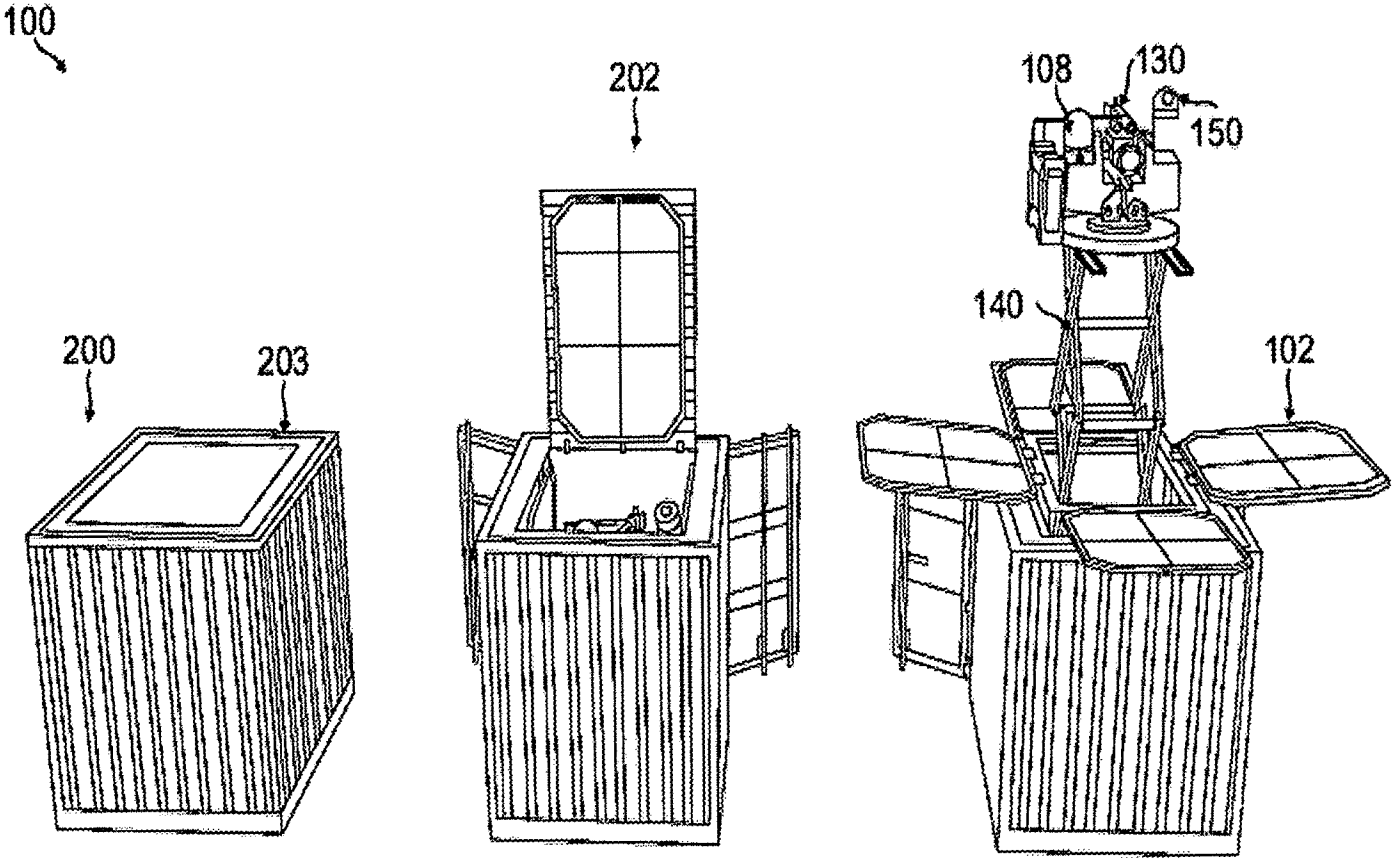
FIG. 2A is a back perspective view of the unmanned system in FIG. 1A in a closed and secured state.
FIG. 2B is a back perspective view of the unmanned system in FIG. 1A in a opened and secured state.
FIG. 2C is a back perspective view of the unmanned system in FIG. 1A in an opened and deployed state.

FIG. 2A is a back view of the unmanned system 100 in FIG. 1A in a closed and secured state, FIG. 2B is a back view of the unmanned system 100 in FIG. 1A in a opened and secured state, and FIG. 2C is a back view of the unmanned system 100 in FIG. 1A in an opened and deployed state.

Referring to FIGS. 1A, B, and C, in an exemplary embodiment, the unmanned weapon system 100 may be configured to fit within a conventional intermodal-shipping container 200. The unmanned weapon system 100 may be equipped with a plurality of modular solar panels 102 disposed on a lid 202 of the intermodal-shipping container 200, a modular array of batteries 104, a modular computing processing unit 106, a communication transponder 108, and a lifting system 140 coupled to a plurality of weapon systems 130.

In exemplary embodiments, the unmanned weapon system 100 may include modular and replaceable emergency supplies 109, including bandages and a first aid kit, and a secondary backup motor to operate all functions of the unmanned weapon system 100, including the lifting system 140 and the weapon system 130.

The unmanned system 100 may be formed with a frame 204 configured to fit within an interior 201 of the intermodal-shipping container 200. The frame 204 and the interior of the intermodal-shipping container 200 may be fitted with various types of shields or protective material 206 in order to protect the components of the unmanned system 100 from electromagnetic pulses (EMP), water, heat, vibration or other forces or projectiles acting upon the container 200.

The intermodal-shipping container 200 includes a movable lid 202 which is coupled to a body 205 of the intermodal-shipping container 200 with hinges 203. However, the present general inventive concept is not limited thereto. That is, the movable lid 202 may include a flexible or rollable lid which may be opened and closed. The intermodal-shipping container 200 may further include a first wall 200*a* and a second wall 200*b* which are attached to the body 205 by hinges, such that the first wall and second wall may be opened to access and/or replace components within the intermodal-shipping container 200. The body 205 may be formed of stainless steel or various types of metals and may store an array of batteries 104, a modular magazine storage 132, a base 142 and supports 144 for the lifting system 140.

In alternative exemplary embodiments, the first wall 200*a* may further include a locking system 200*c* which is used to protect the unmanned weapon system 100 from unauthorized access. That is, the locking system 200*c* may include a keypad entry locking mechanism, a biometric lock, and/or a RFID locking system. The locking system 200*c* is configured to be hidden from view in order to conceal that the ordinary looking intermodal-shipping container 200 contains an unmanned weapon system 100.

In exemplary embodiments, the lifting system 140 is secured to the frame 204 and is configured to raise and lower a plurality of weapon systems 130 attached thereto. The lifting system 140 may include a scissor-type lifting system. As illustrated in FIG. 1A, in a closed and secured state, the lid 202 of the unmanned weapon system 100 is closed and the weapon system 130 is secured. However, when a user wishes to deploy the weapon system 130, the lid 102 is first opened, as illustrated in FIG. 1B, and the lifting system 140 is raised, as illustrated in FIG. 1C. As the lid 202 is opened, the solar panels 102 disposed on an interior surface of the intermodal-shipping container 200 is exposed to the external environment and may be exposed to sunlight in order to charge the modular array of batteries 104 or provide power to various components of the unmanned weapon system 100.

In exemplary embodiments, the unmanned weapon system 100 may use the plurality of solar panels 102 as its primary energy source. However, the present general inventive concept is not limited thereto. That is, the unmanned weapon system 100 may use various other types of alternative energy sources, such as nuclear, wind, solar, natural gas, AC power or DC power. In alternative exemplary embodiments, the unmanned system 100 may further include a generator 320 disposed within the container 200 to provide power to the unmanned weapon system 100.

Figure 3:
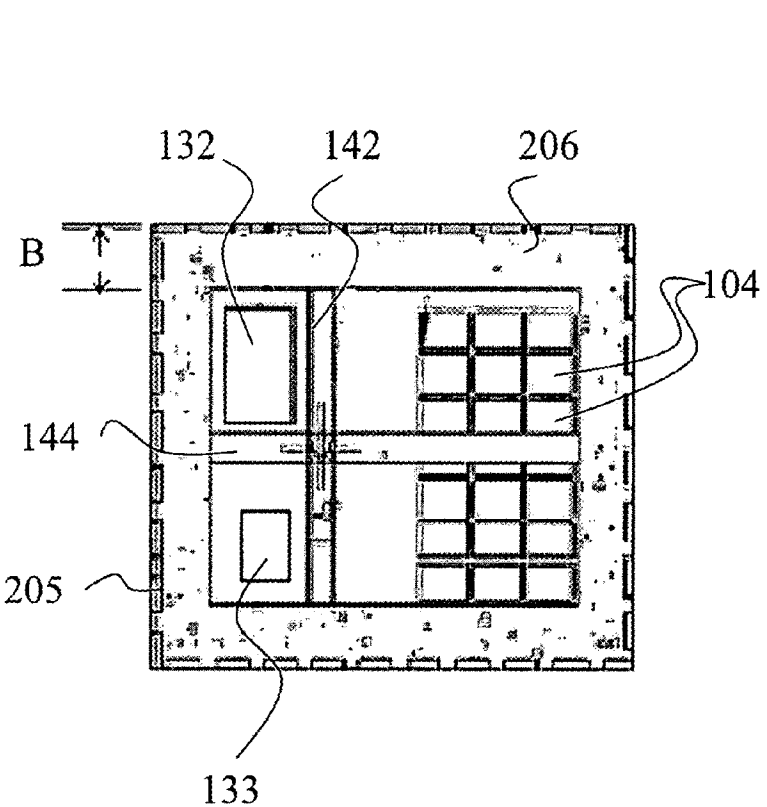
FIG. 3A is a schematic side plan view of the unmanned system illustrated in FIG. 1 in a closed and secured state.
FIG. 3B is a schematic cross-sectional top view along line A-A illustrated in FIG. 3A.
Figure 3:
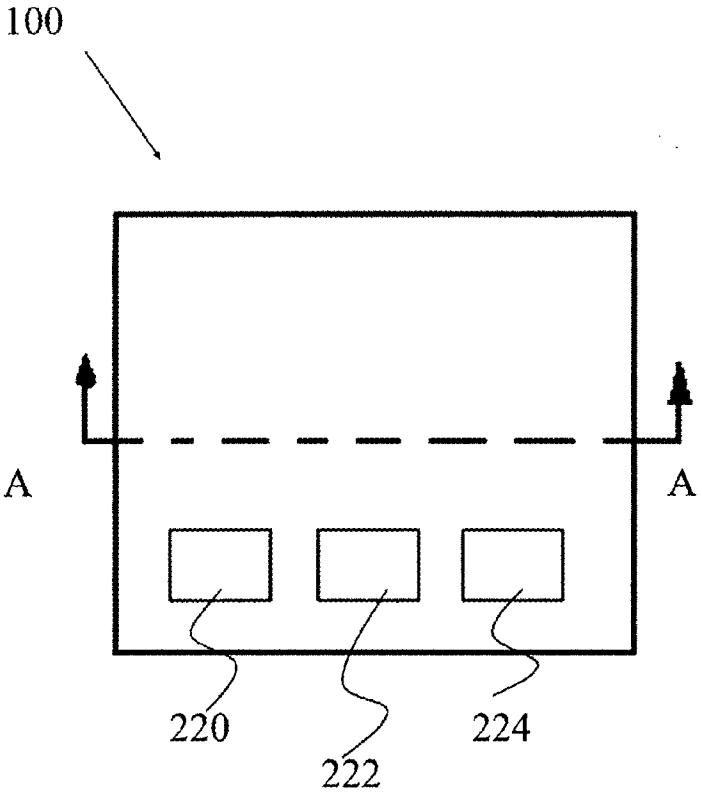

FIG. 3A is a schematic side plan view of the unmanned system 100 illustrated in FIG. 1 in a closed and secured state and FIG. 3B is a schematic cross-sectional view along line A-A illustrated in FIG. 3A.

Referring to FIG. 3A, in an exemplary embodiment, the unmanned weapon system 100 may further include a recharging station 220 (see FIG. 7A) disposed on an exterior wall 200*a* of the intermodal-shipping container 200. The recharging station 220 is electrically coupled to the power source within intermodal-shipping container 200 to thereby provide power to recharge a plurality of manned or unmanned vehicles, helicopters, planes, drones, or robots coupled to the recharging station 220.

Similarly, the unmanned weapon system 100 may further include a refueling station 222 which is in fluid communication with a fuel storage compartment 133 within the unmanned weapon system 100 to thereby refuel a plurality of manned or unmanned vehicles, helicopters, planes, drones, or robots coupled to the refueling station 222. However, the present general inventive concept is not limited thereto.

That is, once the unmanned weapon system 100 is deployed, various other types of unmanned vehicles or manned vehicles may use the recharging station 220 to recharge batteries, the refueling station 222 to refuel vehicles, and/or a data transfer station 224 to send/receive sensitive data. For instance, an unmanned helicopter (not illustrated) may land on a top surface of the intermodal-shipping container 200 and establish a connection to the recharging station 220, the refueling station 222, and/or the data transfer station 224 of the unmanned weapon system 100 in order to receive fuel, power, communications, commands, ammunition, or various other types of upgrades.

Referring to FIG. 3B, in an exemplary embodiment, an interior area of the intermodal-shipping container 200 may include a concrete shield 206 having a predetermined thickness and composition or various other materials to provide strength and armor. For instance, in an exemplary embodiment, the concrete shield 206 may be formed to a thickness B of between one (1) foot to three (3) feet. In addition, the electrical components of the unmanned weapon system 100 may further be electrically shielded from EMP by materials integrated within the walls 200*a* of the conventional intermodal-shipping container 200.

Figure 4:
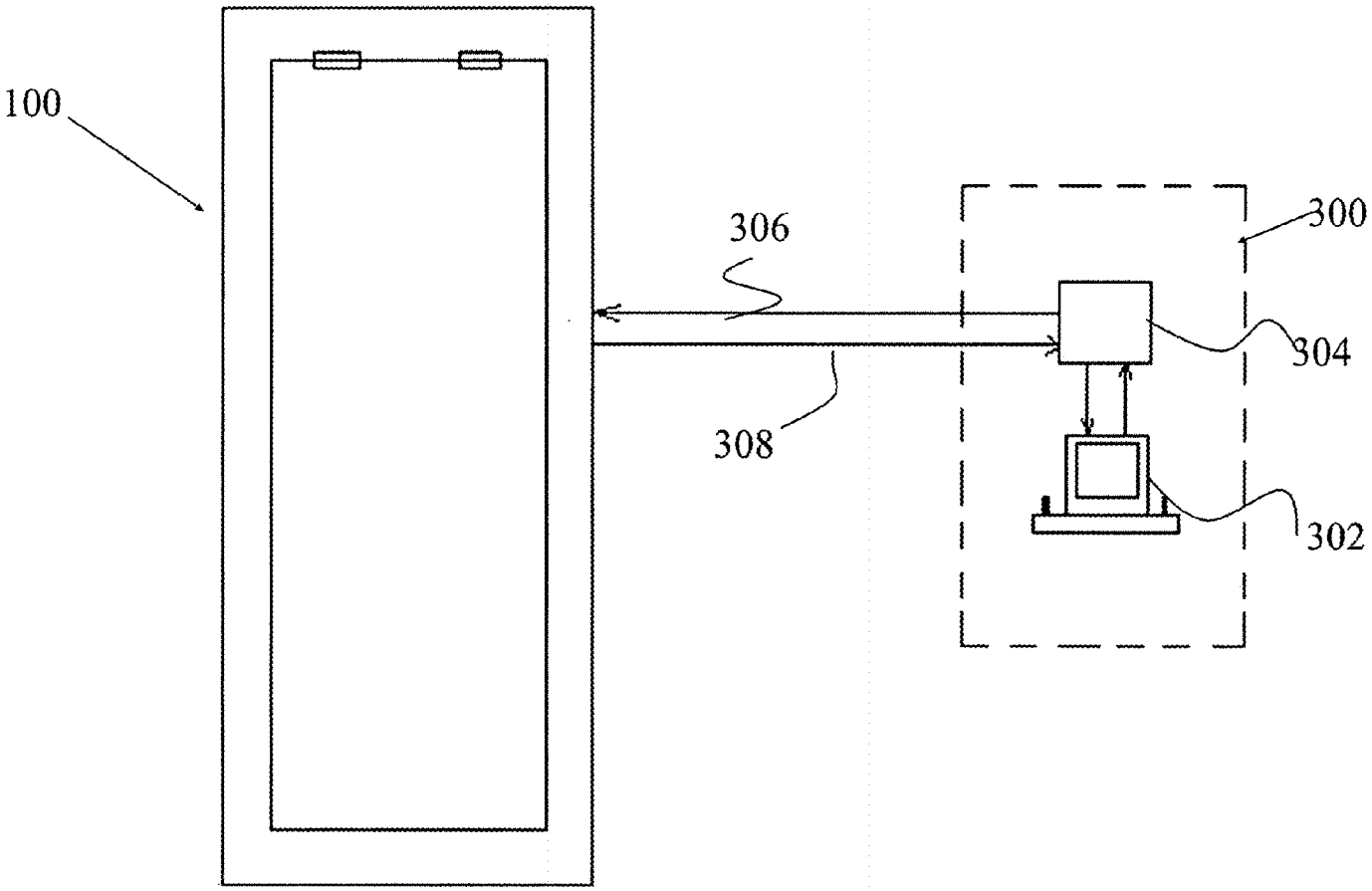
FIG. 4 is a schematic view of the unmanned system and a mobile command center according to an exemplary embodiment of the present invention.
Figure 5:
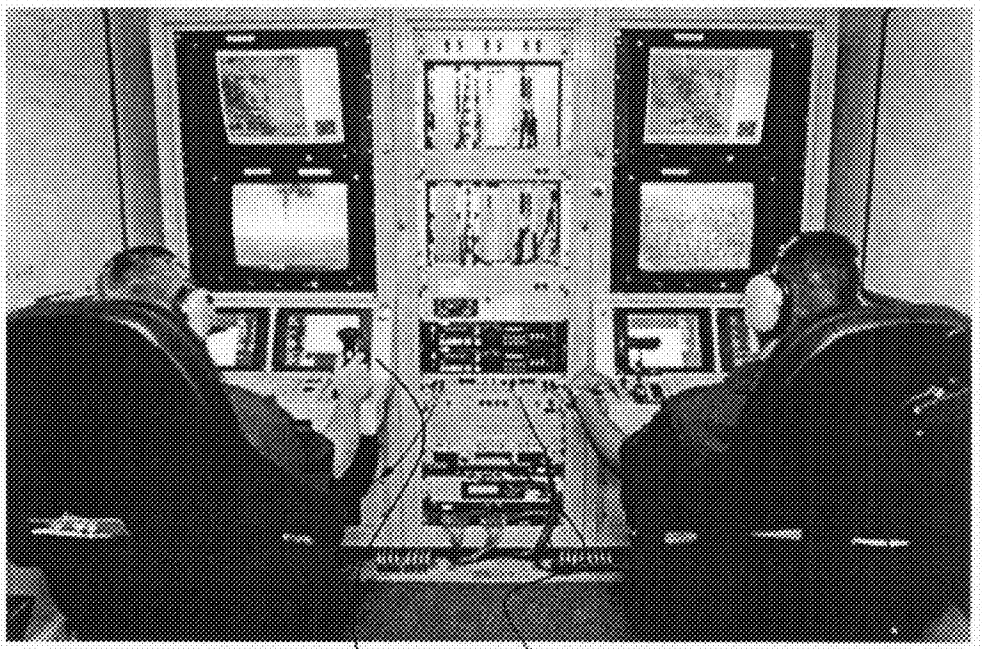
FIG. 5 is a photograph a conventional interior of a mobile command center which may be used to control the present general inventive concept.

FIG. 4 is a schematic view of the unmanned system 100 and a mobile command center 300 according to an exemplary embodiment of the present invention. FIG. 5 is a photograph an interior of the mobile command center 300 according to an exemplary embodiment of the present general inventive concept.

Referring to FIG. 4, in an exemplary embodiment, a user may manually or remotely control the functions of the unmanned weapon system 100 through a mobile command center 300. The mobile command center 300 includes a user control station 302 and an encrypted communication system 304. The user may utilize the user control station 302 to control the unmanned weapon system 100. That is, the user may send signals 306 and/or receive signals 308 from/to the modular computing processing unit 106 to open and close the lid 202, lower and raise the lifting system 140, monitor audio and video feeds, fire the weapon systems 130, and/or detonate a self-destruction sequence to prevent the unmanned weapon system 100 from unauthorized access.

The communication system 304 of the mobile command center 300 may communicate with the modular communication transponder 108 via a cable or remotely via wireless communication. The mobile command center 300 sends and receives signals to/from the unmanned weapon system 100 to thereby control, monitor, and operate all operations and functions of the unmanned weapon system 100.

In an exemplary embodiment, the mobile command center 300 receives signals including an audio and video feed from the camera system 150 mounted on the lifting system 140. However, the present invention is not limited thereto. That is, the unmanned weapon system 100 may further include hidden cameras, pressure sensors, motion detections, and various other electronic surveillance systems to protect the unmanned weapon system 100, which may also be controlled and monitored by the mobile command center 300.

Referring to FIGS. 1A, B, and C, in an exemplary embodiment, the lid 202 of the intermodal shipping container 200 may open to expose a concealed weapon system 130. An inner side portion of the lid 202 may be fitted with solar panels 102 to provide power to the unmanned system 100. Additionally, in a preferred embodiment, the concealed weapon system 130 may be surrounded by photovoltaic cell array panels 102 fore and aft, as well as on either side. However, the present general inventive concept is not limited thereto.

As illustrated in FIG. 1C, the weapon system 130 may be raised using the lifting system 140, as a tower. In exemplary embodiments, the camera system 150 may be coupled to the weapon system 130, wherein the images from the camera are communicated to a remote control location and/or the mobile command center 300. That is, the camera and weapon system may be monitored and controlled from a remote office or the mobile command center 300.

In an exemplary embodiment, a support, a guide and an armature may be connected to the lifting system 140 so that the photovoltaic cell array panels 102 will open to an external environment when the lifting system 140 rises and will close when the lifting system 140 lowers.

Figure 6:
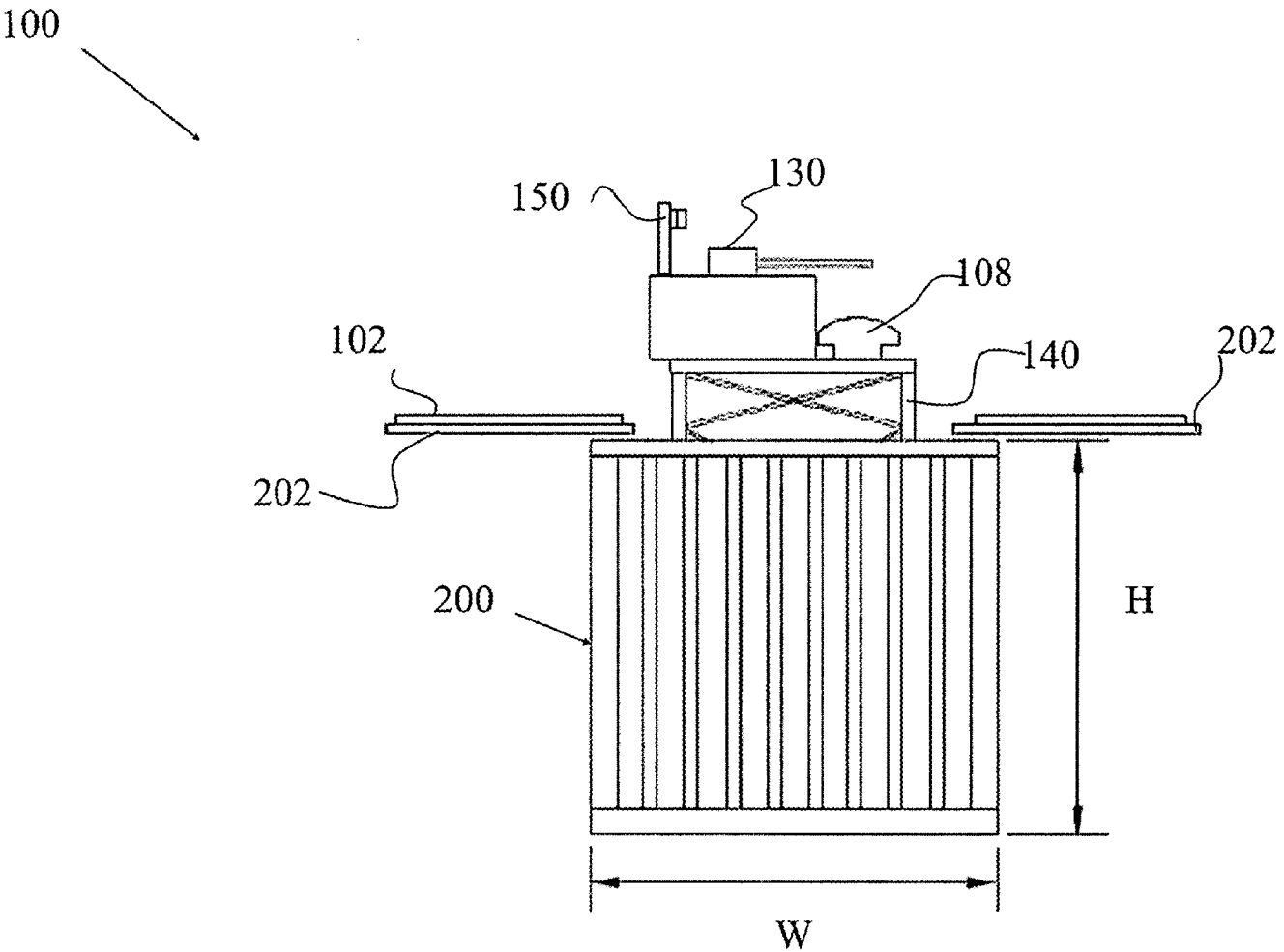
FIG. 6 is a schematic side view of the unmanned system according to another exemplary embodiment of the present invention, in an open and deployed state.
Figure 7:
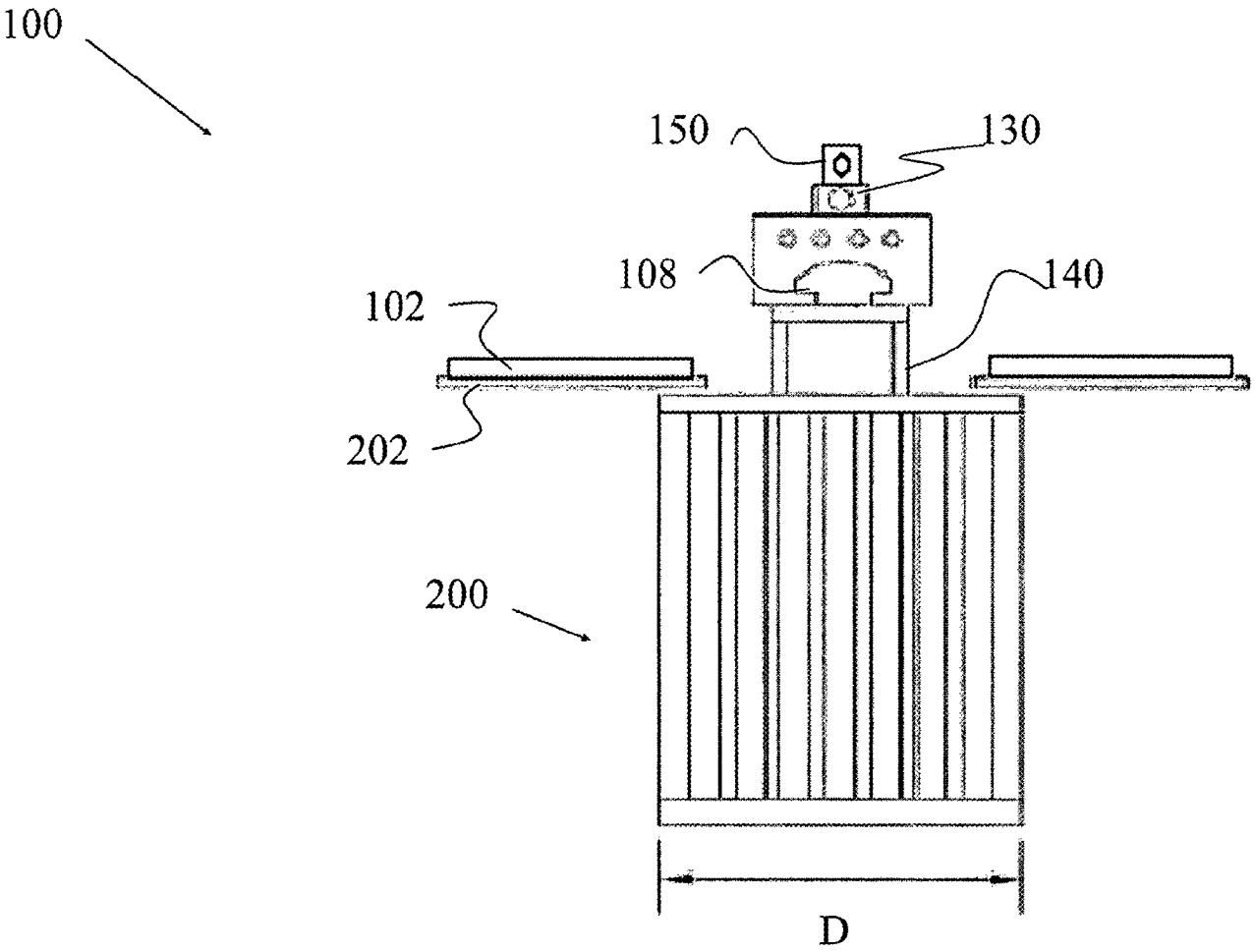
FIG. 7 is a schematic front view of the unmanned system illustrated in FIG. 6, in an opened and deployed state.
Figure 8:
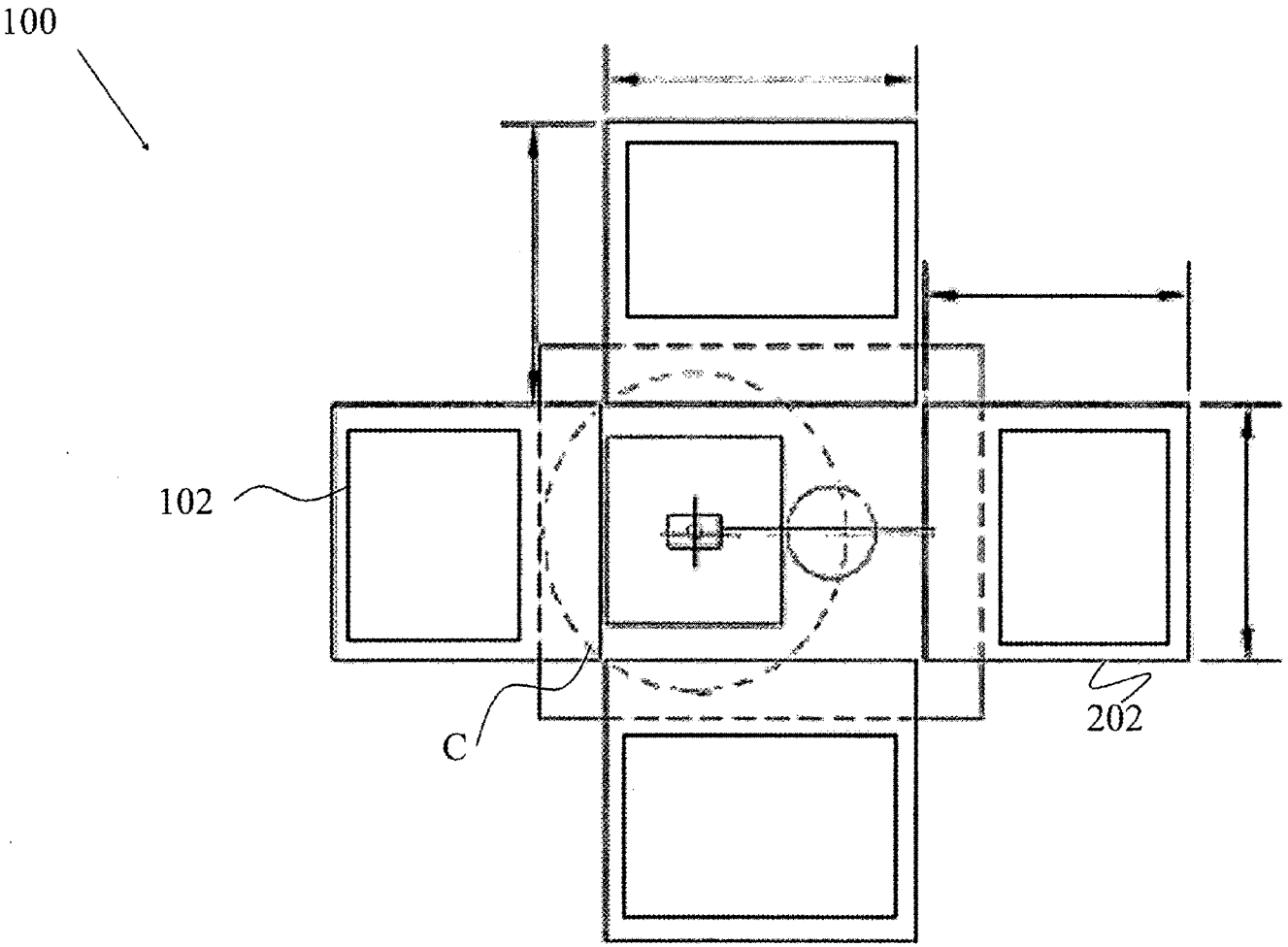
FIG. 8 is a schematic top plan view of the unmanned system illustrated in FIG. 7, in an opened and deployed state.

FIG. 6 is a schematic side view of the unmanned system 100 according to an exemplary embodiment of the present invention in an open and deployed state, FIG. 7 is a schematic front view of the unmanned system illustrated 100 in FIG. 5 in an opened and deployed state, and FIG. 8 is a schematic top plan view of the unmanned system illustrated 100 in FIG. 6 in an opened and deployed state.

Referring to FIGS. 6, 7, and 8, in an exemplary embodiment, the unmanned system 100 may be configured to fit an interior storage compartment of an intermodal shipping container 200 having an exterior width W between five (5) feet and fifty (50) feet, an exterior height H between five (5) feet and fifty (50) feet, and depth D between five (5) and fifty (50) feet. However, the present general inventive concept is not limited thereto. That is, in alternative exemplary embodiments, the dimensions of the intermodal shipping container 200 may be manufactured to incorporate the exterior dimensions of the unmanned system 100.

Referring to FIG. 8, reference letter C illustrates a path wherein the weapon system 130 and/or the camera system 150 is allowed to rotate.

The present inventive concept incorporates technical manufacturing requiring fewer tools and materials, thereby creating a more powerful design with a simpler system such as the elevator/lift, battery, computer, armature, guide, solar panels, and the like. The present invention further includes a unique motor design to raise and lower the lifting system.

According to an exemplary embodiment of the present invention, the unmanned system 100 may be transported to a desired location by a helicopter, plane, truck, or ship. Once the unmanned system 100 is deployed at a desired location, the communication system within the system 100 may either be manually activated by an operator or remotely activated by a remote operator to begin the assembly of the unmanned system 100.

The bullets, missiles, or other consumable materials used by the weapon system 130 may be replenished by a modular magazine 132 stored within the intermodal shipping container 200. Similarly, the batteries 104 and the modular computing processing unit 106 may be easily replaced.

Figure 9C:
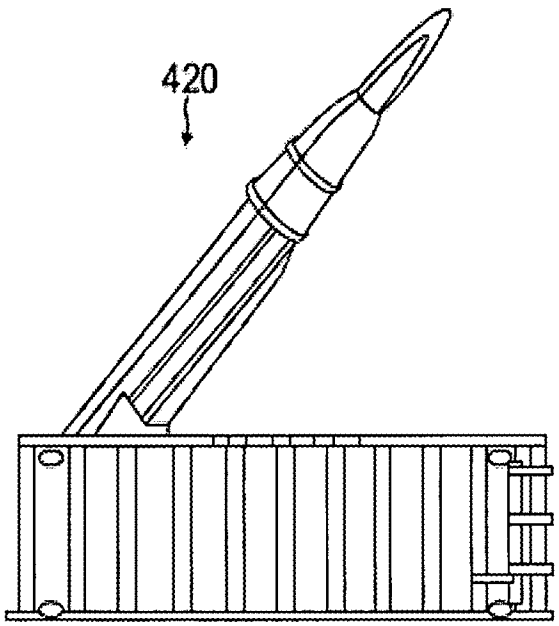
FIG. 9C is a side view of an unmanned system according to another exemplary embodiment of the present general inventive concept.
Figure 9B:
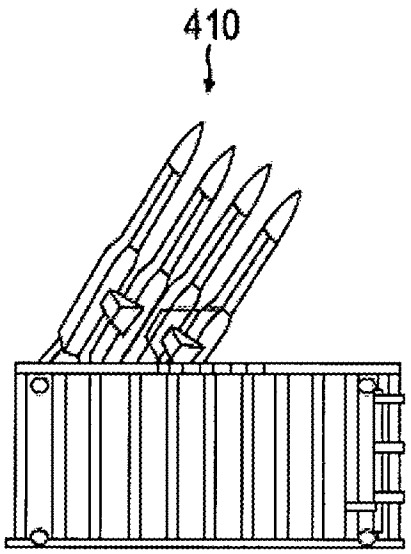
FIG. 9B is a side view of an unmanned system according to another exemplary embodiment of the present general inventive concept.
Figure 9A:
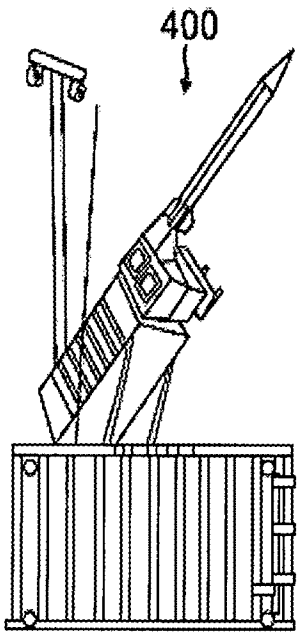
FIG. 9A is a side view of an unmanned system according to another exemplary embodiment of the present general inventive concept.
Figure 10:
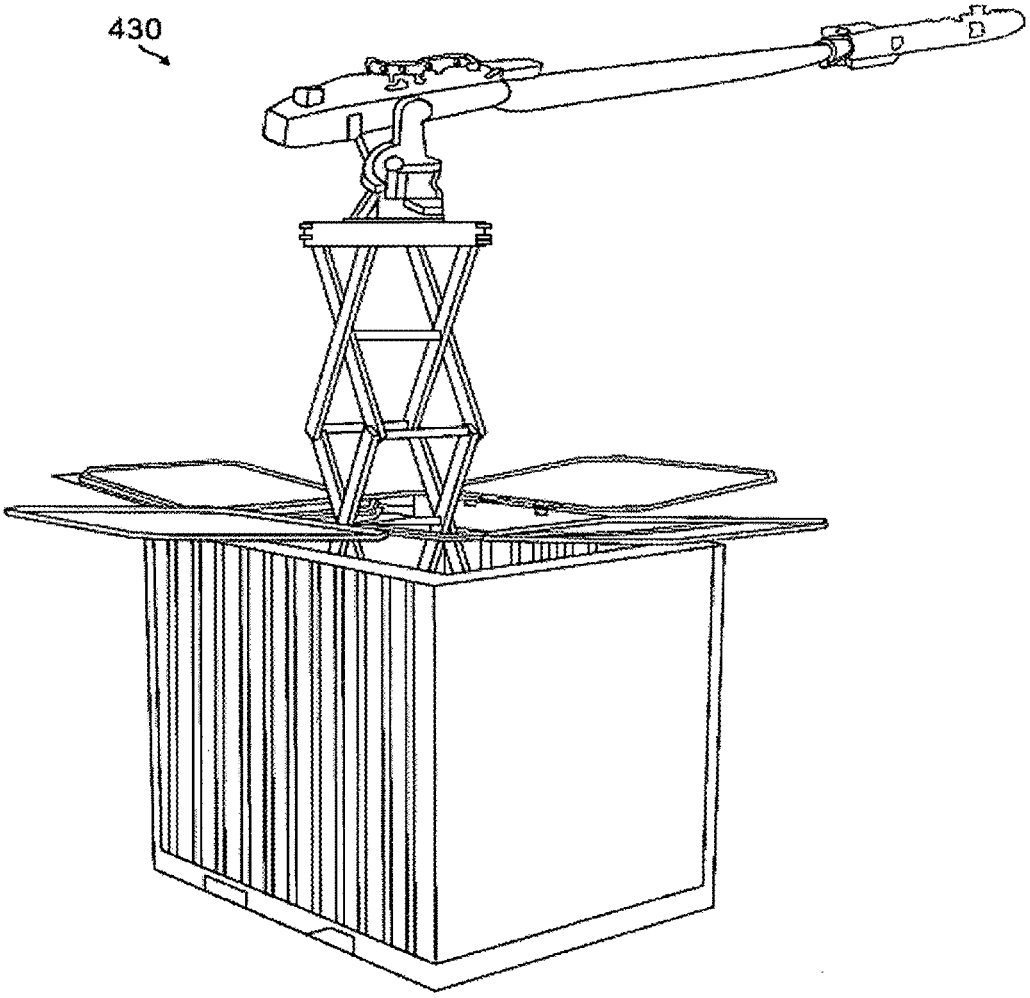
FIG. 10 is a front perspective view of an unmanned system in an opened and deployed state, wherein the weapon system is fired.
Figure 11:
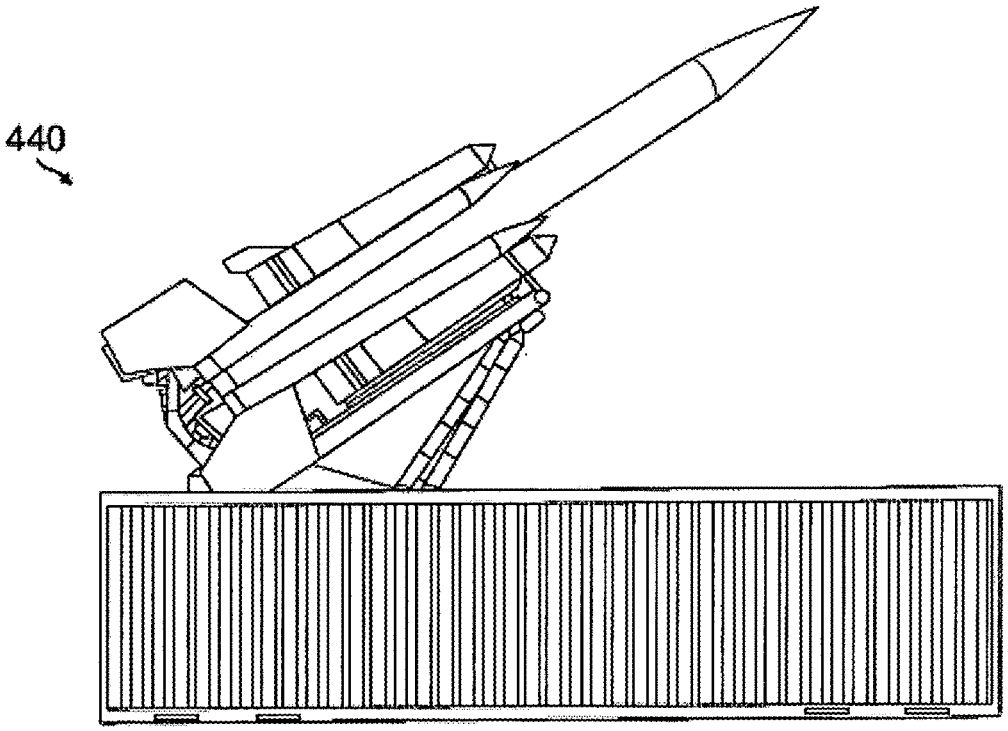
FIG. 11 is a side view of an unmanned system according to another exemplary embodiment of the present general inventive concept.
Figure 12:
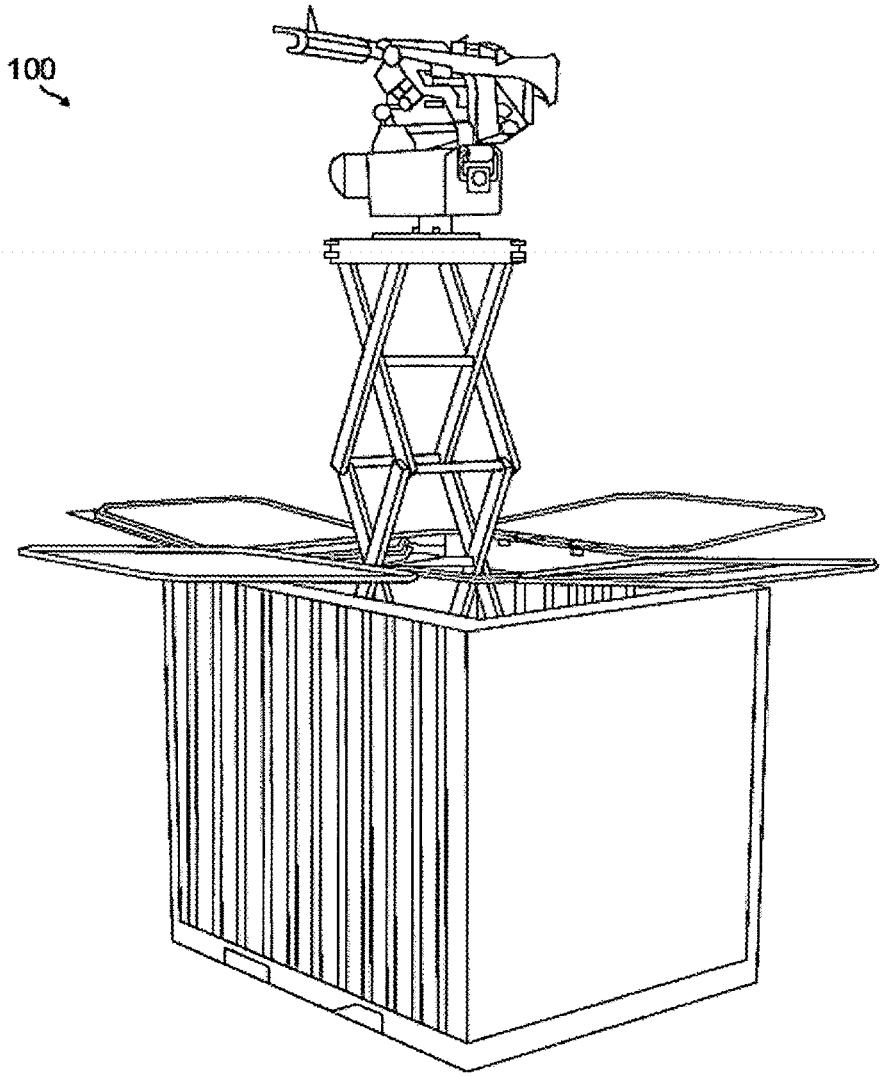
FIG. 12 is a front perspective view of the unmanned system in an opened and deployed state, wherein the system is positioned to guard a desired location.

In exemplary embodiments, referring to FIGS. 9A,B, and C, the weapon system 130 may include rockets and artilleries, hell fire stations, anti-aircraft missiles, anti-tank missiles, gatlin and machine guns, surveying and monitoring devices, non-lethal weapons, microwave laser guns, psychological warfare using sound systems, and grenade and tear gas launchers. However, the present general inventive is not limited thereto.

In exemplary embodiments, the size of intermodal shipping container 200 may vary as desired. That is, the longitudinal length of the intermodal shipping container 200 may be 10 feet, 20 feet, 30 feet, or 40 feet. However, the present general inventive concept is not limited thereto. That is, the length of the intermodal shipping container 200 may correspond to the dimensions of the desired weapon system 130 disposed within the container 200. For instance, the machine gun may occupy 5 feet and may be disposed within a 10 foot intermodal shipping container 200 and the surface to air missile system may occupy 32 feet and may be disposed within a 40 foot intermodal shipping container 200.

All modular components within the unmanned system 100 may be interchangeable and easily replaceable. The components may comply with international standards such as (ISO) and may be configured to fit all trucks, trains, ships, planes, and trailers.

Figure 13:
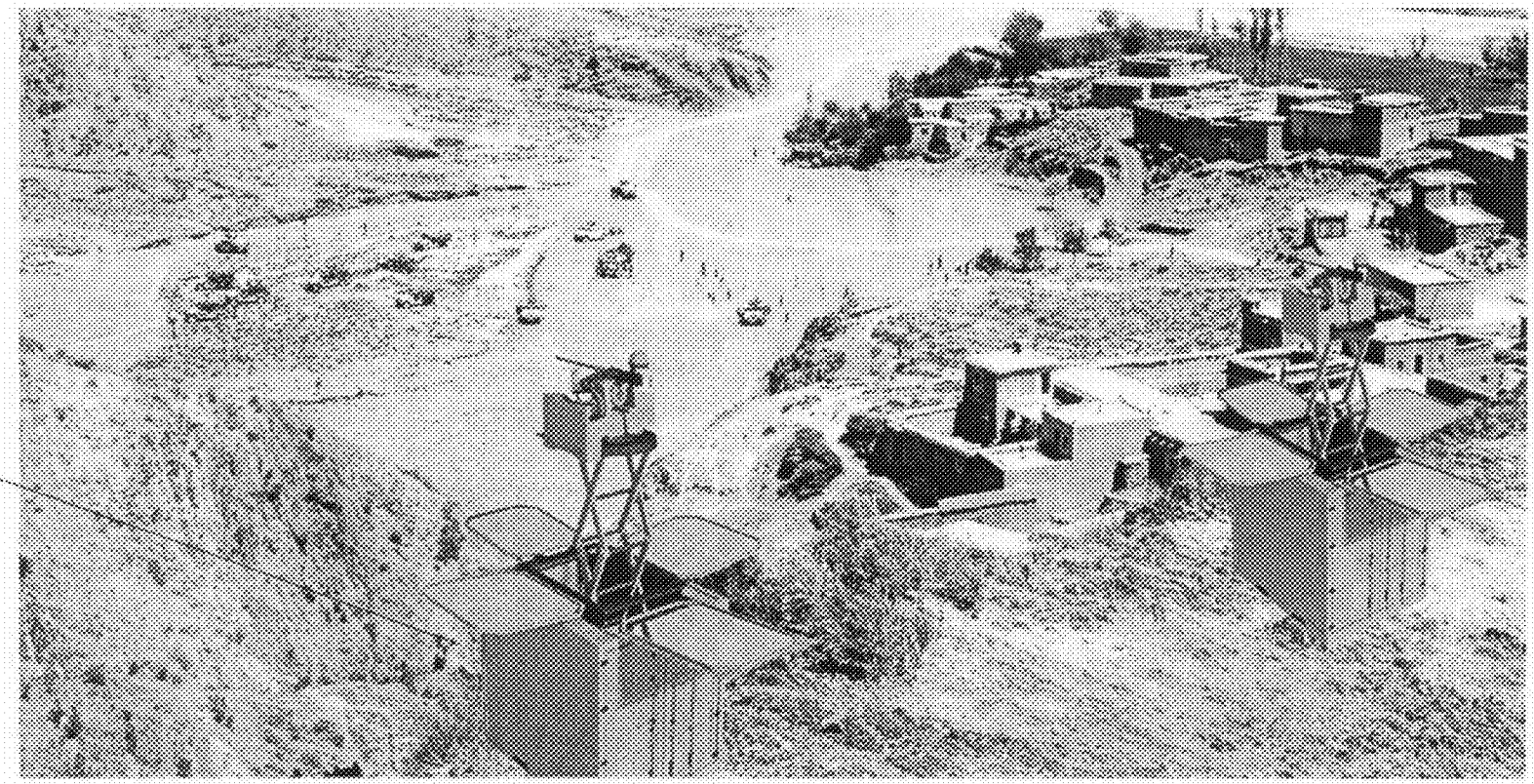
FIG. 13 is a front perspective view of the unmanned system in an opened and deployed state, wherein the system is positioned to guard a desired location in battle, such as a mountain side.
Figure 14:
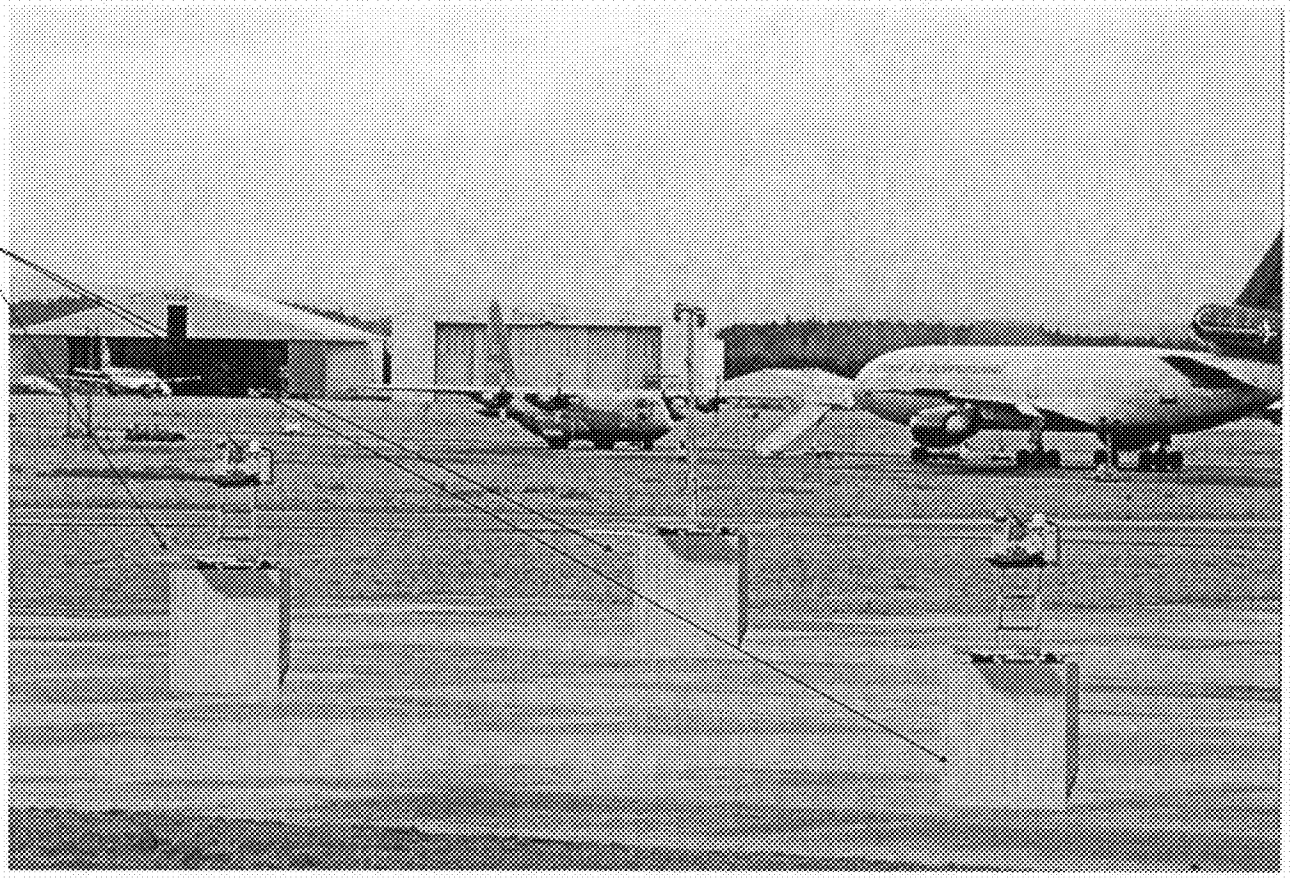
FIG. 14 is a front perspective view of the unmanned system in an opened and deployed state, wherein the system is positioned to guard an airfield location.
Figure 15:
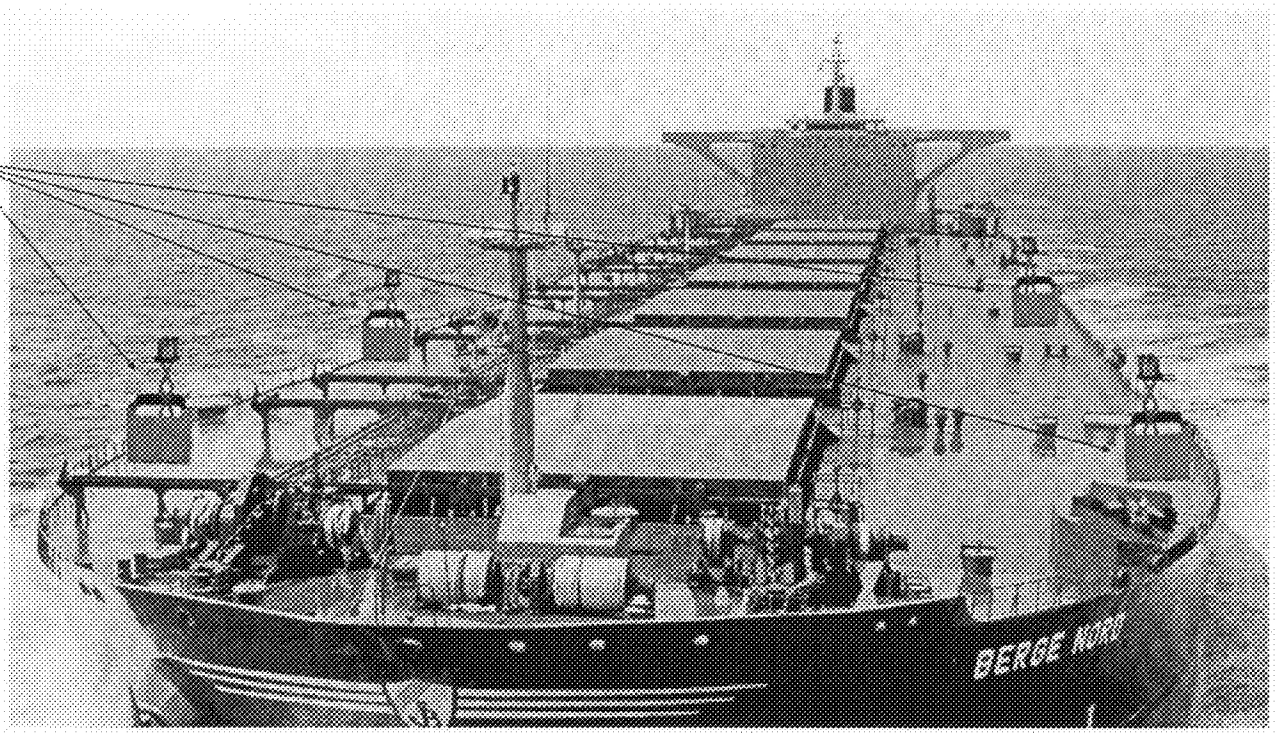
FIG. 15 is a front perspective view of the unmanned system in an opened and deployed state, wherein the system is positioned to guard an oil freighter.

In further alternative exemplary embodiments, the unmanned system 100, including a desired weapon system 130, may be deployed on battlefields (FIG. 13), strategic defense placements, emergency conflicted areas, airports (FIG. 14), petroleum refineries (FIG. 15), cargo ships (FIG. 16), tractor trailers (FIG. 17), petroleum depots, embassies, schools, hospitals, and any other vulnerable area prone to attacks.

In addition, the unmanned system 100 may also be deployed in urban areas to protect against civil unrest and/or natural disaster looting.

Figure 16:
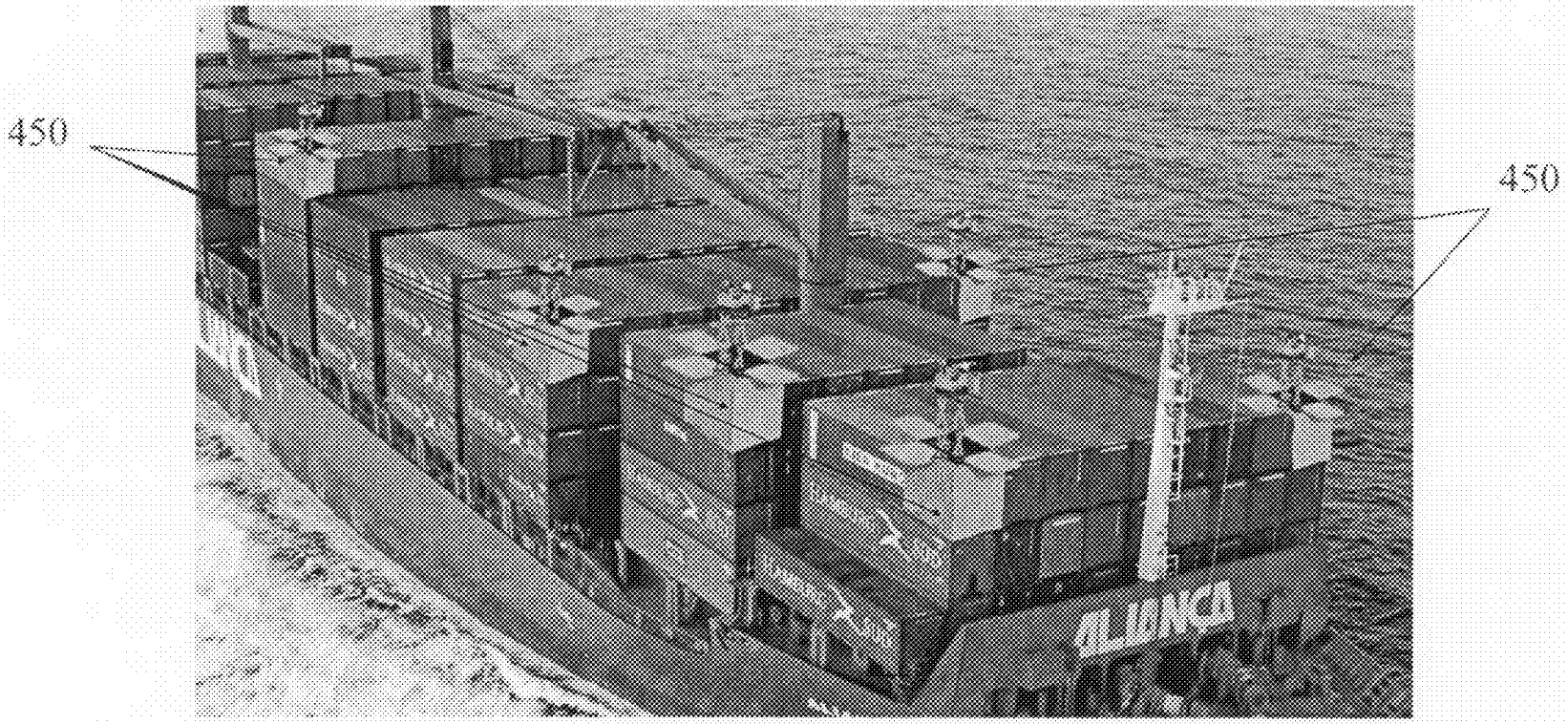
FIG. 16 is a front perspective view of the unmanned system in an opened and deployed state, wherein the system is positioned to guard a cargo ship.
Figure 17:
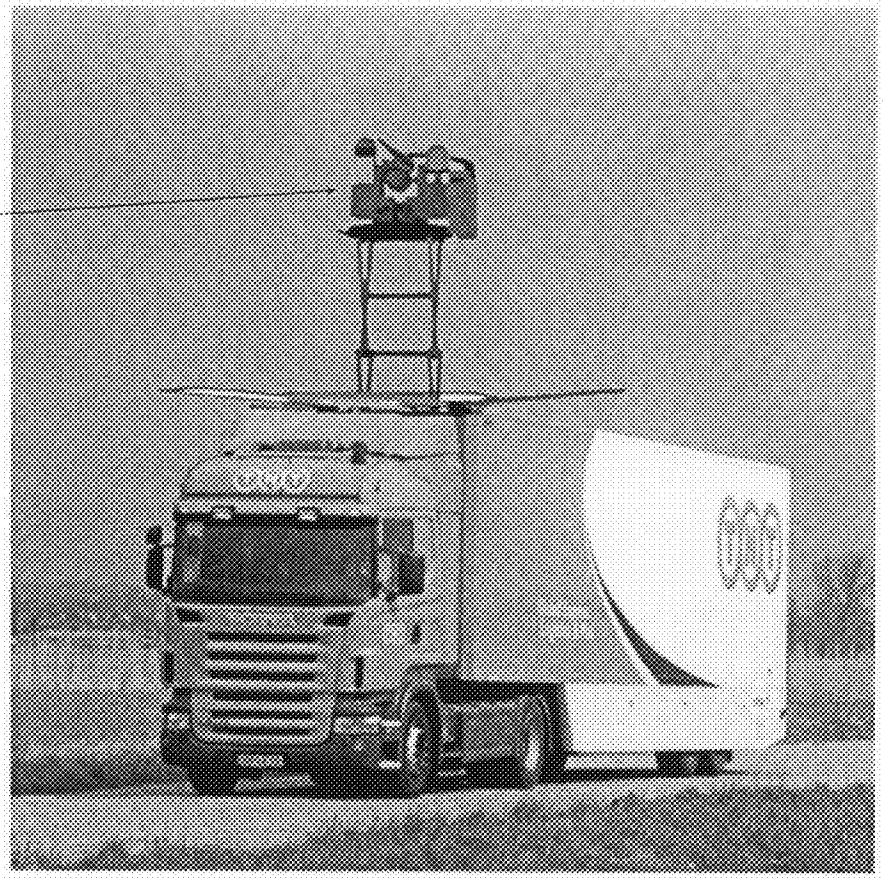
FIG. 17 is a front perspective view of the unmanned system in an opened and deployed state, wherein the system is positioned within a tractor trailer.
Figure 18:
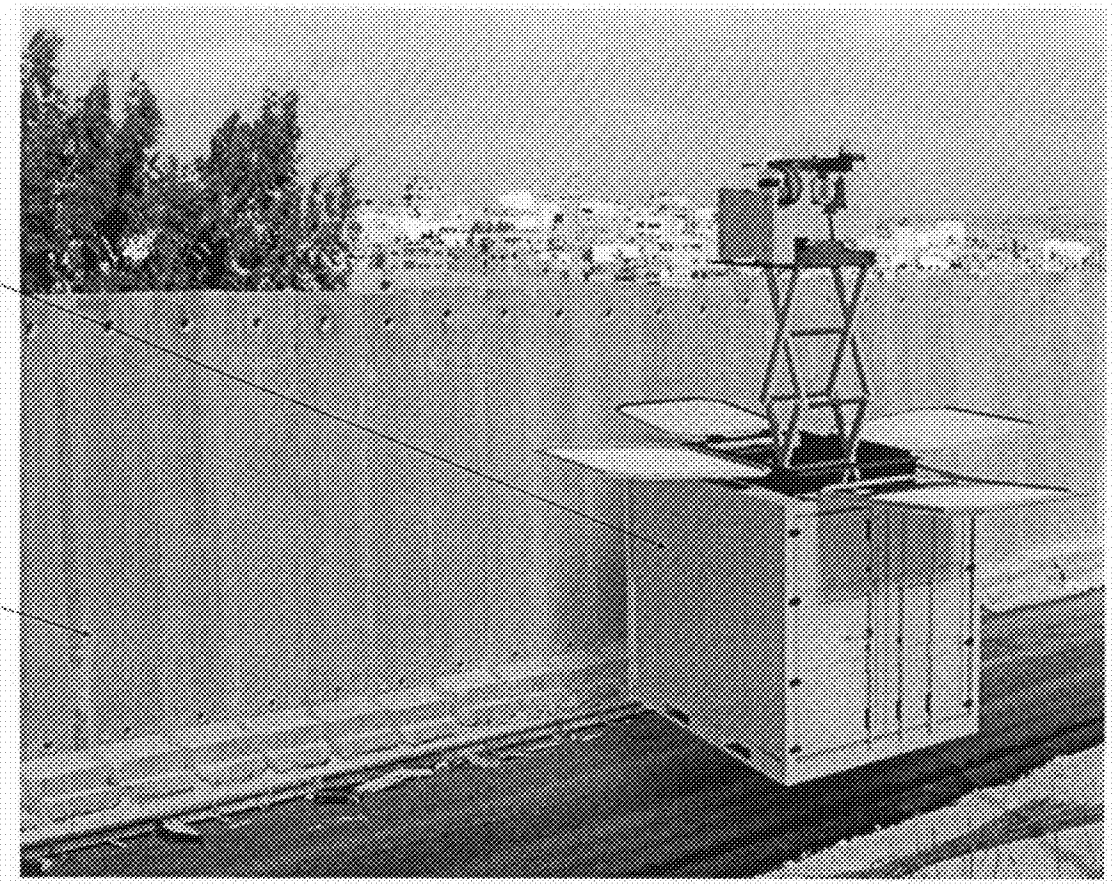
FIG. 18 is a front perspective view of the unmanned system in an opened and deployed state, wherein the system is positioned behind a barrier in a hostile environment.
Figure 19:
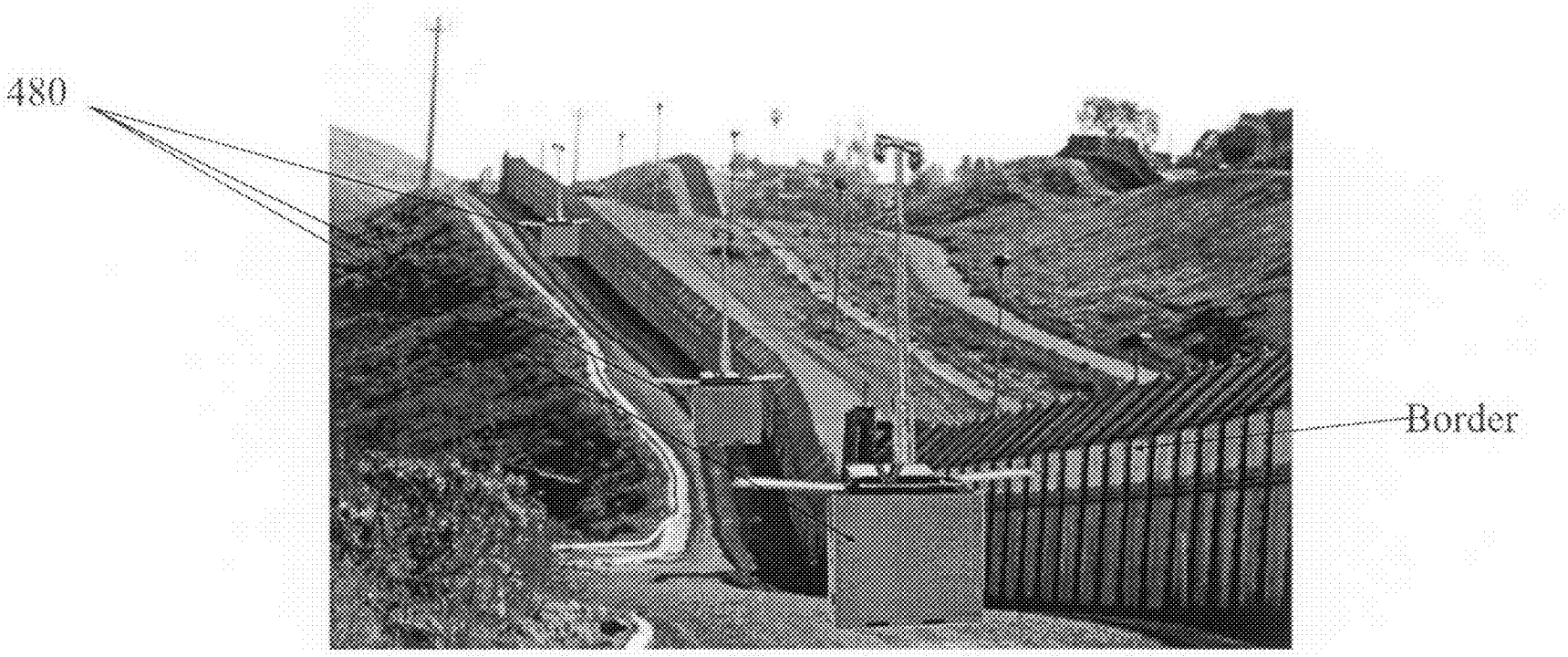
FIG. 19 is a front perspective view of the unmanned system in an opened and deployed state, wherein the system is positioned along a border.
Figure 20:
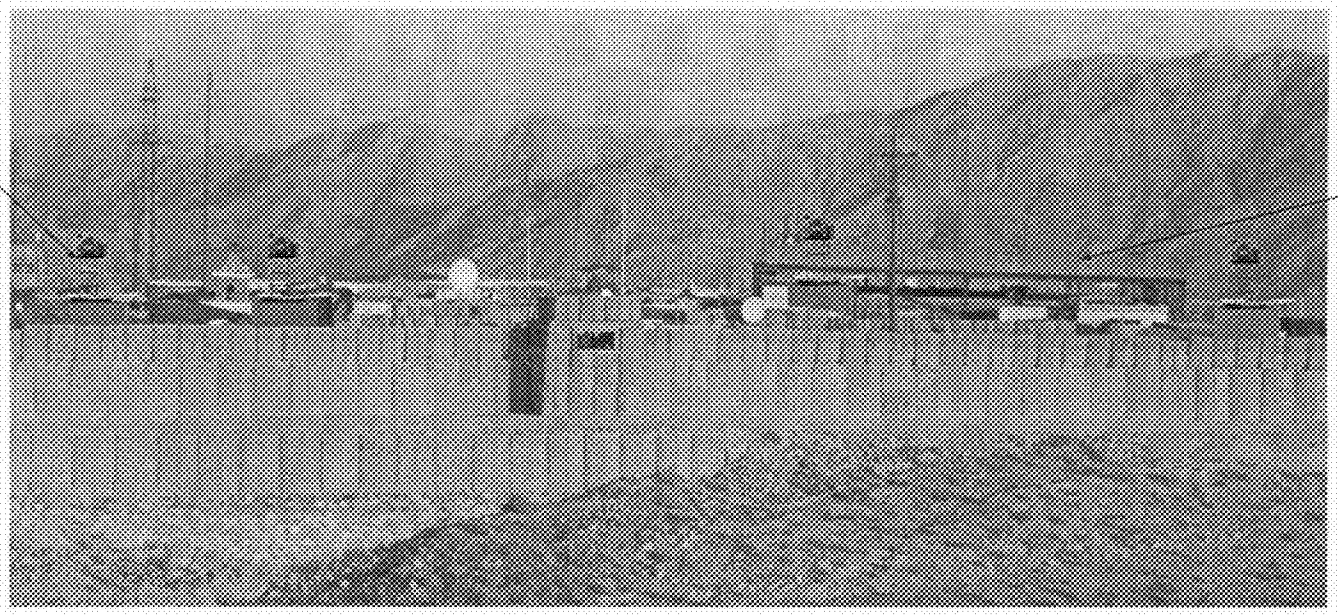
FIG. 20 is a front perspective view of the unmanned system in an opened and deployed state, wherein the system is positioned along protective barrier of a base.
Figure 21:
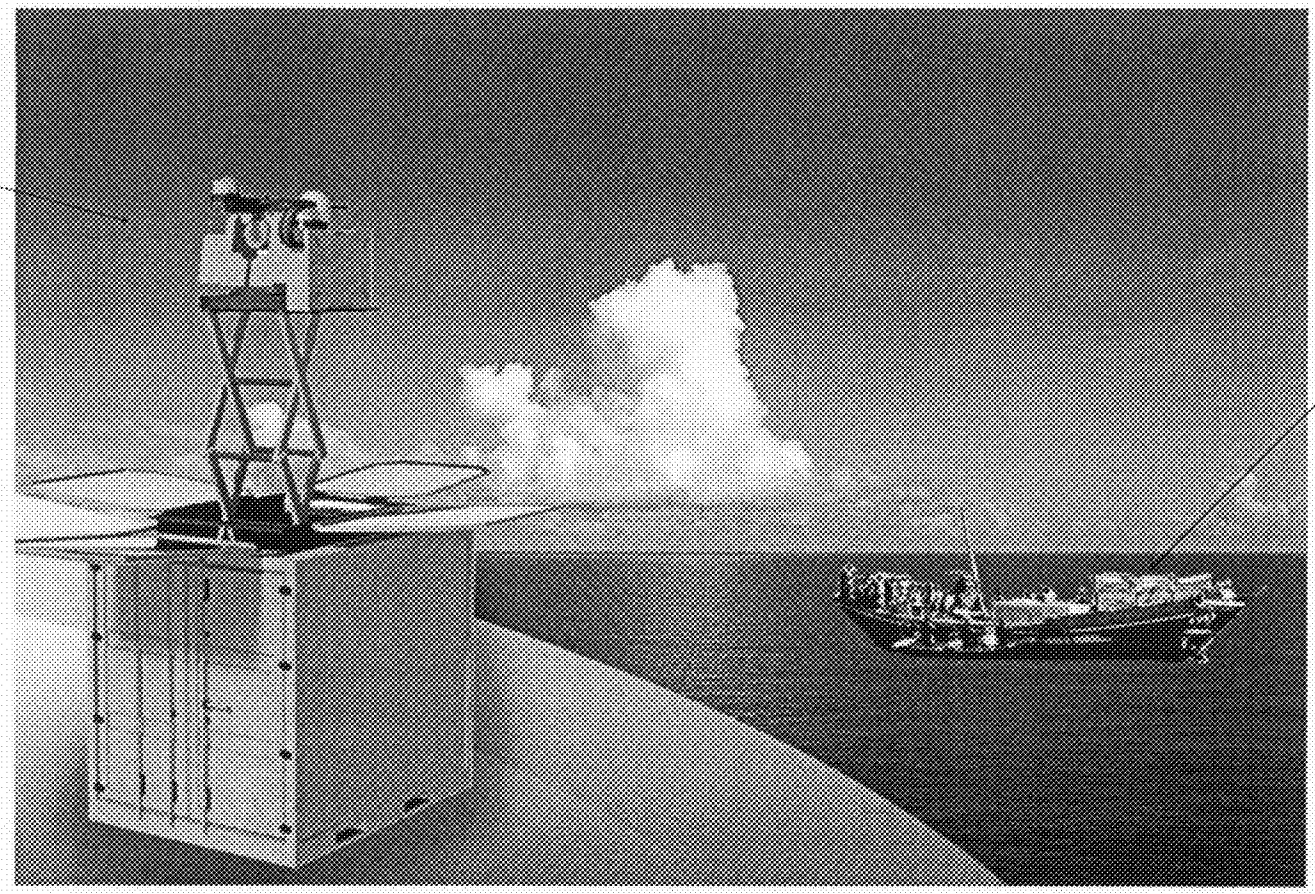
FIG. 21 is a back perspective view of the unmanned system in an opened and deployed state, wherein the system is positioned along a coast to protect against pirates.
Figure 22:
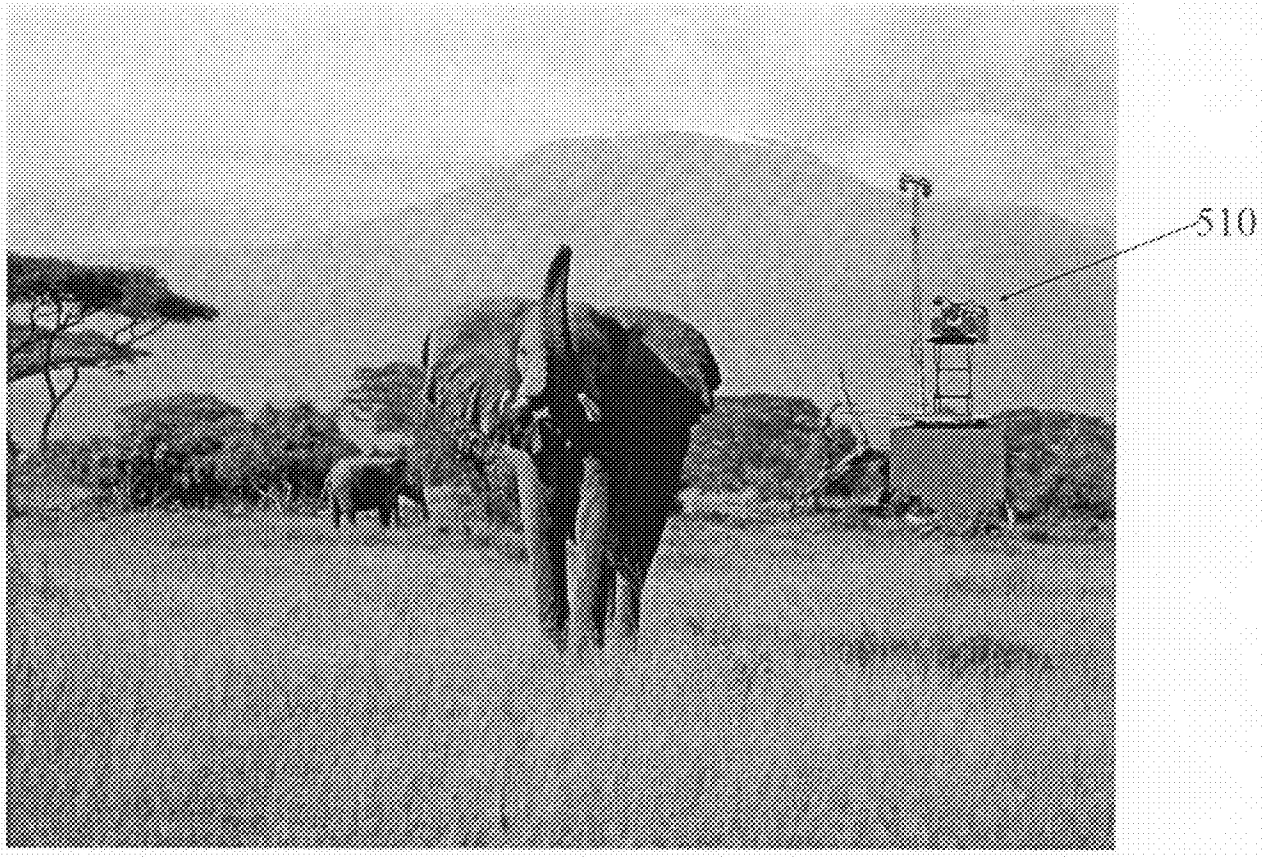
FIG. 22 is a front view of the unmanned system in an opened and deployed state, wherein the system is positioned in a national park to protect against poachers.

The unmanned system 100 may also be deployed on ships and trains as shipping escort containers positioned at various locations of a cargo ships or trains (FIG. 16).

In alternative embodiments, the unmanned system 100 may also be deployed as a protective shelter for civilians, authorized personnel, soldiers, and/or wounded medic centers. The unmanned system 100 may protect and be used to transport these people.

Figure 23:
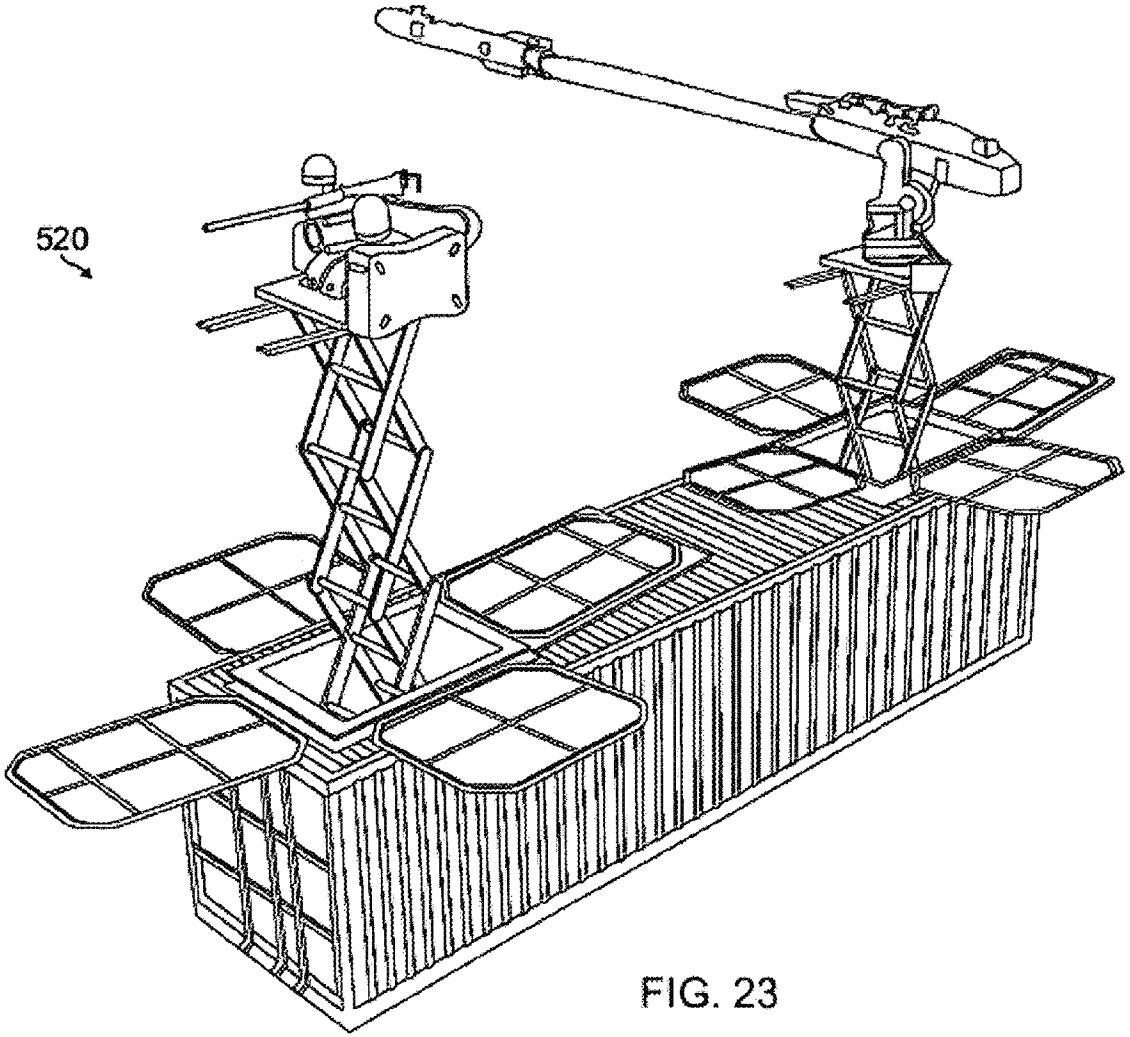
FIG. 23 is a top perspective view of an unmanned system according to another exemplary embodiment of the present general inventive concept integrating multiple weapon systems.
Figure 24:
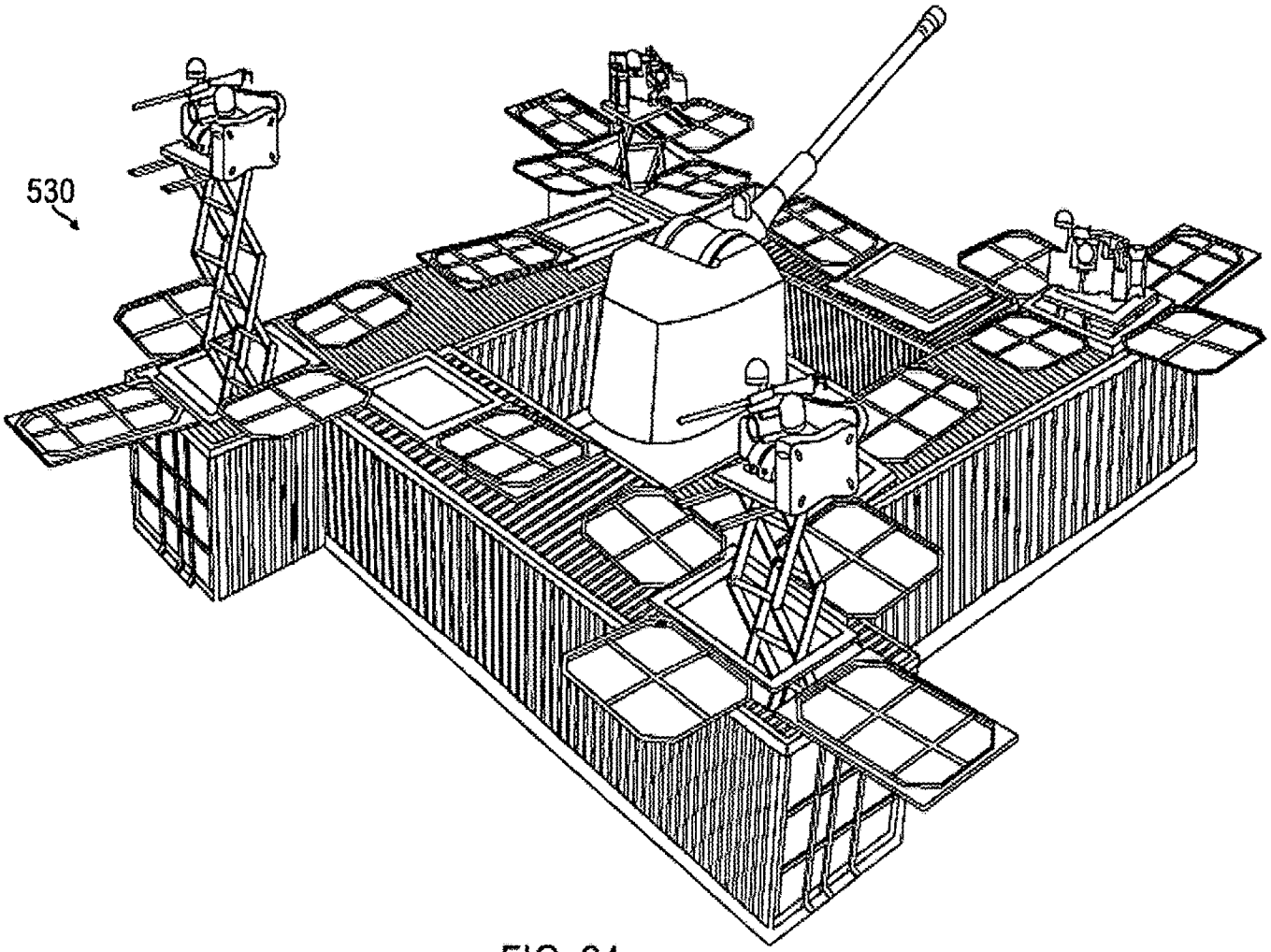
FIG. 24 is a top perspective view of an unmanned system according to another exemplary embodiment of the present general inventive concept configured into a base.
Figure 25:
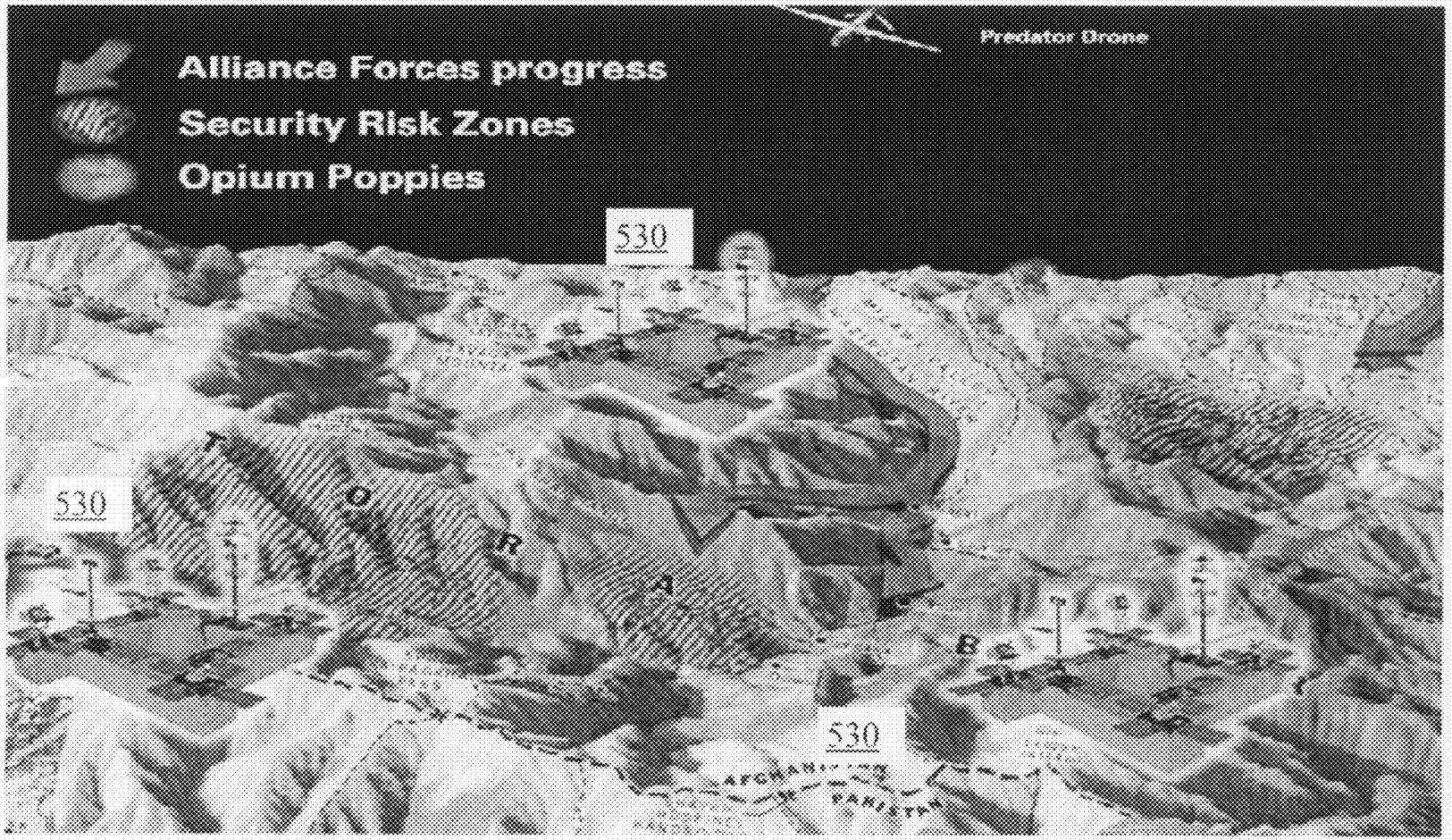
FIG. 25 is an example of an alternate embodiment of the unmanned system demonstrating utilization of multiple bases coordinating multiple battlefield goals.

FIG. 23 is a top perspective view of an unmanned system 520 according to another exemplary embodiment of the present general inventive concept integrating multiple weapon systems. FIG. 24 is a top perspective view of an unmanned system 530 according to another exemplary embodiment of the present general inventive concept configured into a base. FIG. 25 is an example of an alternate embodiment of the unmanned system demonstrating utilization of multiple bases coordinating multiple battlefield goals.

The unmanned system 100 may further integrate multiple weapons and systems within a single container 200. That is, for example, within the 40 foot container 200, the unmanned system 100 includes two 10 Foot AUTMMIC coupled together. (See FIG. 23).

In an alternative embodiment, unmanned system 100 may be used as a tool for counter-insurgent doctrine: A significant advantage of the AUTMMIC system is that it may be configured into a base 530 (the "Democrator" base) (See FIG. 24), a portable, quickly constructed and self-contained anti-guerrilla unit. The result is improved performance during dangerous conditions and reduced replacement costs, representing significant cost-saving advantages. Each Democrator base consists of at least four AUTMMIC units that may be configured in cooperation with one another. The base may be used with a centrally located unmanned and automated MRSI, long-range (15-30 miles radius), artillery gun that has precision targeting synchronized through existing Unmanned Aerial Vehicles (UAV) systems. In addition, as protection for the artillery, four or more AUTMMIC units can be used with machine guns, a hellfire station and an antenna or another tool that the user wishes to use.

This design enables four close-range fires from each end of the base, while the central launching mechanism allows for a 360-degree launch of long-range shells. Unlike aerial support, the Democrator base is designed for use any time in all types of weather conditions with rapid-fire (less than two minute) artillery response on the battlefield.

The base may be operated remotely or through mobile control, which provides the operator with the ability to acquire and engage targets from remote or mobile stations. The base requires no ground transportation, thus avoiding potential landmines or enemy ground attacks.

A plurality of Democrator bases may be used to support multiple battlefield goals, as can be seen in FIG. 25, and this system can assert strategic dominance over a region as small as 100 miles or large as several thousand miles. The system may also be used to patrol a broad area such as the Great Wall of China or protect a specific objective such as a bridge, an airport or vital extraction/transport points.

Additionally, this system reduces dependence on air support and allows civil forces to work in a safe area. Each Democrator base is capable of supporting other area Democrators. To secure an area the size of South Afghanistan, 30 bases are recommended.

Further, in conjunction with the use of a UAV these bases are easily replaceable in the event of attacks. AUTMMIC units can be simply replaced and the damaged containers can be refortified and/or new AUTMMIC units utilized. AUTMMIC also easily fits within international transportation standards, enabling maritime transport to the destined region and ground transport, or air transport via helicopter to the final site if desired.

There are also significant cost advantages to using the Democrator system. For example, the Democrator bases can be constructed immediately, and the AUTMMIC units are weather-resistant and flood-proof.

Additionally, if a UAV spotted a desired target on the ground, the GPS coordinates may be communicated to the nearest base Democrator (preferably less than 30 miles) to activate the bombing. This would avoid the UAV having to return to base to recharge munitions and allow the UAV to stay longer in the area. If a company were to fall victim to an ambuscade, it would simply need to indicate the presence of enemies in one place to enable the artillery bombardment.

Additionally, the present invention comprises a method for providing an unmanned mobile intermodal container weapon (AUTMMIC) system 100, wherein a weapon system may be lowered for concealment and raised when it is to be used. The method may comprise the steps of transporting the AUTMMIC system to a desired location, by means of an intermodal shipping container 200. Power may be provided by means of a plurality of modular solar panels or by battery or one or more generators. A computer processing unit may be activated by a remote operator, who in turn may accomplish the steps of assembling AUTMMIC system. The step of assembling may include raising a desired weapon system 130 by means of a lifting system, that may further comprise a scissor platform 140. A top flap of said intermodal shipping container 200 may be opened thereby allowing the system to expose its solar panel to an external environment for charging and also allowing the system to transmit images from a camera system.

The method of the present invention also comprises utilizing a plurality of AUTMMIC systems working together to form a Democrator Base as desired.

It is to be understood that the foregoing illustrative exemplary embodiments have been provided merely for the purpose of explanation and are in no way to be construed as limiting of the present general inventive concept. Words used herein are words of description and illustration, rather than words of limitation. In addition, the advantages and objectives described herein may not be realized by each and every exemplary embodiment practicing the present general inventive concept. Further, although the present general inventive concept has been described herein with reference to particular structure, steps and/or exemplary embodiments, the present general inventive concept is not intended to be limited to the particulars disclosed herein. Rather, the present general inventive concept extends to all functionally equivalent structures, methods and uses, such as are within the scope of the appended claims. Those skilled in the art, having the benefit of the teachings of this specification, may affect numerous modifications thereto and changes may be made without departing from the scope and spirit of the present general inventive concept.

What is claimed is:

1. A method for operating a weapon system comprising the steps of:

transporting said weapon system to a desired location, wherein said weapon system comprises:

an intermodal shipping container;

an unmanned weapons unit configured to fit within the intermodal shipping container;

a modular energy source capable of providing power to said weapon system;

a modular computing processing unit disposed within said intermodal shipping container;

a lifting system, wherein said lifting system is capable of raising said unmanned weapons unit from said intermodal shipping container;

a camera system, wherein said camera system is capable of capturing images and communicating said images to said modular computing processing unit; and a recharging station coupled to said modular energy source and disposed on an exterior wall of said intermodal shipping container to provide power;

providing power to said weapon system using said modular energy source;

activating the modular computer processing unit of said weapon system by a remote operator;

activating said weapon system by using said modular computer processing unit;

raising said unmanned weapons unit by using said lifting system, wherein a top flap of said intermodal shipping container is opened; and transmitting images from said camera system, wherein said camera system coordinates with said unmanned weapons unit.

2. The method of claim 1, wherein said top flap is fitted with a panel capable of utilizing solar energy.

3. The method of claim 1, further comprising a plurality of weapon systems.

4. The method of claim 3, wherein said plurality of weapon systems comprise a total of four weapon systems.

5. The method of claim 4, wherein said four weapon systems are configured in a substantially quadrilateral base.

6. The method of claim 1, further comprising recharging a plurality of vehicles using the recharging station.

7. The method of claim 1, further comprising refueling vehicles using a refueling station.

8. The method of claim 1, further comprising establishing a connection between the weapon system and a vehicle to receive communications.

* * * * *